US012061072B2

(12) United States Patent
Armstrong

(10) Patent No.: US 12,061,072 B2
(45) Date of Patent: Aug. 13, 2024

(54) COLLAPSIBLE AND SELF-CONTAINED TARGET STAND

(71) Applicant: Daniel Aaron Armstrong, Steamboat Springs, CO (US)

(72) Inventor: Daniel Aaron Armstrong, Steamboat Springs, CO (US)

( * ) Notice: Subject to any disclaimer, the term of this patent is extended or adjusted under 35 U.S.C. 154(b) by 231 days.

(21) Appl. No.: 17/710,046

(22) Filed: Mar. 31, 2022

(65) Prior Publication Data

US 2022/0316844 A1 Oct. 6, 2022

Related U.S. Application Data

(60) Provisional application No. 63/168,275, filed on Mar. 31, 2021.

(51) Int. Cl.
*F41J 1/10* (2006.01)

(52) U.S. Cl.
CPC ..... *F41J 1/10* (2013.01)

(58) Field of Classification Search
CPC ..... F41J 1/00; F41J 1/10; B25H 1/04; B25H 1/06
See application file for complete search history.

(56) References Cited

U.S. PATENT DOCUMENTS

| | | | | |
|---|---|---|---|---|
| 2,698,771 | A * | 1/1955 | O'Rourk | B25H 1/06 182/186.3 |
| 4,726,593 | A * | 2/1988 | Wade | F41J 1/10 273/392 |
| 9,658,035 | B2 * | 5/2017 | Pixton | F41J 1/10 |
| 11,162,765 | B2 * | 11/2021 | Tennison | F41J 1/10 |
| 11,466,967 | B2 * | 10/2022 | Babcock | F41J 7/04 |
| 2018/0087881 | A1 * | 3/2018 | Bickel | F41J 7/04 |

* cited by examiner

*Primary Examiner* — Laura Davison
(74) *Attorney, Agent, or Firm* — Jason H. Vick; Sheridan Ross, PC

(57) ABSTRACT

A self-contained and collapsible target stand includes a main body and at least one stand leg insertable into the main body. The target stand is capable of transitioning between an assembled state where the at least one stand leg is inserted into side surface apertures, and a collapsed state where the at least one stand leg is inserted into a cavity defined within the main body. The main body has a top surface with at least one support member aperture. The at least one support member aperture is capable of receiving a support member for a shooting target.

20 Claims, 25 Drawing Sheets

COLLAPSIBLE AND SELF-CONTAINED TARGET STAND

CROSS-REFERENCE TO RELATED APPLICATIONS

The present application claims the benefit of and priority, under 35 U.S.C. § 119(e), to U.S. Provisional Application Ser. No. 63/168,275, filed on Mar. 31, 2021, entitled "SELF-CONTAINED TARGET STAND," the entire disclosure of which is hereby incorporated herein by reference, in its entirety, for all that it teaches and for all purposes.

BACKGROUND

The present disclosure is generally directed to target stands and, in particular, toward a target stand that is collapsible and self-contained when in either an assembled state or a collapsed state.

Target stands are usable on ranges for pistol and rifle practice. The target stands are configured to support paper printed shooting targets, cardboard printed shooting targets or backers, steel cutouts, plastic cutouts, and other shooting targets. Known target stands have issues with one or more of size, storability, portability, durability, ease of use, use limitations or restrictions, use during inclement weather, and/or safety.

Known target stands are inherently ungainly and/or cumbersome due to non-standard configurations, which have been previously considered necessary to promote stability and to hold a variety of different materials upright as shooting targets for engagement by the shooter. Select shooting targets may be fabricated from materials which are very heavy. The known target stands are similarly very heavy to counterbalance the shooting targets being supported, and/or are very wide or deep (from the shooter's perspective) to spread the weight out over a larger area and keep the shooting target being supported from toppling. Being designed as such, the known target stands are generally large and/or not compact to increase the possibility of success at performing their intended purpose. The known target stands are generally formed from a metal and welded into a specific shape that cannot be altered without damaging their materials and/or function. Known target stands are difficult to transport in a vehicle or move on foot, and are difficult to store without taking up far more space than is actually represented by the materials that make them up. The issues with size, portability, and storability are compounded with having multiple of the known target stands.

Known target stands are generally fabricated to balance weight and size or configuration. In particular, robustness of the fabrication materials used is often reduced as opposed to reducing the size or shape of the known target stands to allow for transportation and/or storage, as reducing the robustness of the fabrication materials generally results in a reduction of weight to accommodate the large size and/or non-standard configuration. Being less robust, the fabrication materials may be more easily damaged during transport or regular use, potentially adversely affecting functionality. The known target stands may also have an increased profile, resulting in more direct impacts from projectiles that miss the shooting targets and may cause increased damage due to the reduced durability.

Known target stands are generally fabricated to be mated with a particular type of shooting target having a particular orientation relative to the target stand. The known target stands are generally not adjustable to accommodate other types of shooting targets in other orientations.

Known target stands are designed to be stable, supporting a heavy load and/or resisting forces put upon them by projectile impacts and/or the wind. Select known target stands, due to their materials and/or design, are unable to function properly in excessive winds and may be blown over, rendering the held shooting targets inaccessible to a shooter. Other known target stands can withstand winds but at a cost of being very ungainly, unnecessarily heavy for the supported type of shooting target with support member (e.g., large surface area targets made of metal, plastic, cardboard, paper, and/or wood), and difficult to transport.

Known target stands may require small parts or fasteners to construct, resulting in lost time during construction and/or the needing to misplaced parts or fasteners if misplaced during construction. In addition, the addition of parts increases potential tolerance issues, which may increase the possibility the components of the known target stands are not able to couple together.

In general, known target stands may pose a number of safety hazards. Sizes, shapes, heavy weights, and general manners of function of the known target stands may lead to issues during storage, transport, movement, set up, use, and disassembly.

As such, it would be beneficial to provide a target stand which addresses the known issues, above.

BRIEF SUMMARY

The present disclosure is directed to a target stand that is collapsible and self-contained when in either an assembled state or a collapsed state. In particular, the present disclosure is directed to a target stand including a main body and at least one stand leg. The main body is operable to receive a support member for a shooting target, where the support member is coupled to the shooting target or where the support member is an integrated component of the shooting target.

In one non-limiting example, the at least one stand leg may be inserted into the main body at a first location when the target stand is in the assembled state. The at least one stand leg may be insertable into an aperture in a first side surface of the main body. The at least one stand leg may pass through the main body and exit an aperture in a second side surface of the main body opposite the first side surface. At least a portion of the body may rest on an edge or surface of the at least one leg when the at least one leg is inserted into the first side surface of the main body.

In another non-limiting example, the at least one stand leg may be insertable into the main body at a second location when the target stand is in the collapsed state. The at least one stand leg may pass through an aperture on a first end into a cavity defined within the main body. It is noted the aperture may be positioned within the first end at a height from a top surface or a bottom surface of the main body that is equal to or greater than a thickness of the at least one stand leg, to cause the at least one stand leg to enter into the cavity at the increased height and drop an amount equal to or greater than at least the thickness of the at least one stand leg (or combined thicknesses, where there are multiple stand legs). A second end of the body opposite the first end may be solid or without an aperture, to prevent the egress of the at least one stand leg from the second end of the body. Insertion of the at least one stand leg into the main body may allow for a single compact arrangement of components during transportation or storage. For example, the target stand may be transported by a user in a compact configuration with the at least one stand leg inserted within the main body, without concern the at least one stand will inadvertently or prematurely fall out of the main body.

In another non-limiting example, the top surface and/or the bottom surface of the main body may include one or more apertures. The apertures may be operable to receive the support member for the shooting target. The apertures may be in the top surface opposite a solid bottom surface with no apertures. Where the top surface and the bottom surface include apertures, the respective apertures may be aligned or may be offset at predetermined angles to allow for the addition of an angle or slant to the support member for the shooting target. It is noted the apertures on the top surface and/or the bottom surface may be the same size relative to other apertures in the top surface and/or the bottom surface, and/or may be different in size relative to at least one other aperture in the top surface and/or the bottom surface.

Additional features of the present disclosure are directed to a configuration or design which reduces or potentially eliminates existing problems with known target stands. The target stand may be made from robust materials which increase durability and increase performance during normal and adverse weather conditions (e.g., based on material weight or other material properties). The target stand may be designed as a small, collapsible, and self-contained to increase portability and increase storability. The target stand may be designed to be used with and support numerous types and/or designs of shooting targets. The target stand may be designed and assembled without small parts or fasteners, reducing the complexity of the design while preventing the loss of parts and promoting increased assembly, transport, movement, use, and/or disassembly. The target stand may be more safe than known target stands by having a smaller, more compact size and a more stable, low-profile design.

Additional features of the present disclosure are directed to target stand which may be fabricated by any manufacturing process capable of producing a rigid or semi-rigid form or shape. For example, the components of the target stand may be formed from any number of materials capable for producing the rigid or semi-rigid form or shape. The target stand of the present disclosure may be collapsible, self-contained, and compact when not erected for use in the assembled state. The target stand of the present disclosure includes components such as the main body with simple geometric shapes, to allow for increased ease of storage in a number of different configurations based on user preference and available space, and/or to allow for increased ease of transportation in or on any number of vehicles or by the user.

Additional features of the present disclosure are directed to the target stand being fabricated with thicker, more robust materials to reduce damage during use, transportation, and/or storage. The target stand may be designed with a low profile to reduce inadvertent projectile impacts. Although the thicker, more robust materials may result in an increased weight of the target stand to provide a stable platform for the shooting target, the collapsible, compact design allows for increased ease of transport and/or storage.

Additional features of the present disclosure are directed to multiple types of shooting targets being insertable in numerous different orientations.

Additional features of the present disclosure are directed to a heavy, wide, low-profile design when the target stand is in the assembled state, and a compact design when the target stand is in the collapsed state. The target stand of the present disclosure has a low center of gravity, which increases stability to resist the forces of the wind and to prevent large surface area targets (e.g., plastic, paper, cardboard, wood, and other materials) from toppling it over. This results in the target stand of the present disclosure being usable in inclement weather conditions, such as increased wind. The compact size of the collapsed state results in a more storable and transportable design.

Additional features of the present disclosure are directed to a reduced number of parts that are easily coupled together, reduced amount of time lost and the possibility of misplaced components.

Additional features of the present disclosure are directed to reduced risk of hazard by being collapsible and easy to transport, move and store, as well as increased ease of assembly and disassembly. The target stand of the present disclosure a low profile and is unlikely to topple over and injure a user. The low profile also reduces the chances of it being hit by projectiles, thus reducing an amount of projectile fragmentation that may potentially ricochet back in the direction of a shooter or proximate third-party (e.g., an adjacent shooter at a shooting or target range, or other bystanders.

In this regard, the target stand of the present disclosure improves upon or solves many problems that are inherent with most target stands currently available on the market.

The target stand of the present disclosure target stand is more user-friendly than known target stands, being both uniquely collapsible and self-contained which is novel and non-obvious over known target stands. The target stand of the present disclosure addresses issues related to one or more of size, storability, portability, durability, ease of use, use limitations or restrictions, use during inclement weather, and/or safety found to be both common and problematic. The target stand of the present disclosure offers improvements over known target stands in many areas such as size, storability, portability, durability, ease of use, use limitations, weather limitations, and safety.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

Numerous additional features and advantages are described herein and will be apparent to those skilled in the art upon consideration of the following Detailed Description and in view of the figures.

BRIEF DESCRIPTION OF THE SEVERAL VIEWS OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
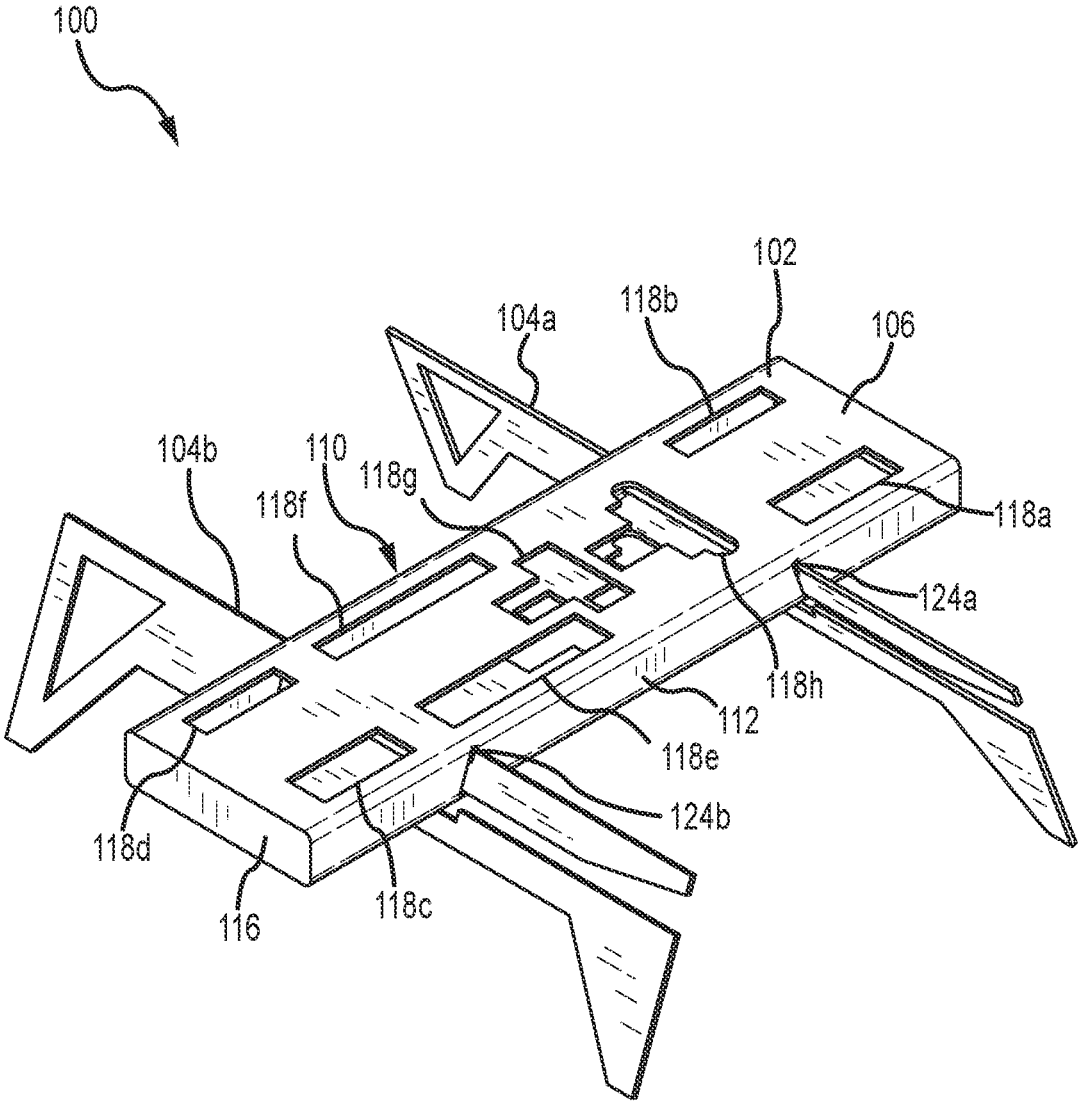
FIG. 1 shows a top perspective view of a target stand including a main body and two legs in an assembled state, in accordance with aspects of the present disclosure.
Figure 2:
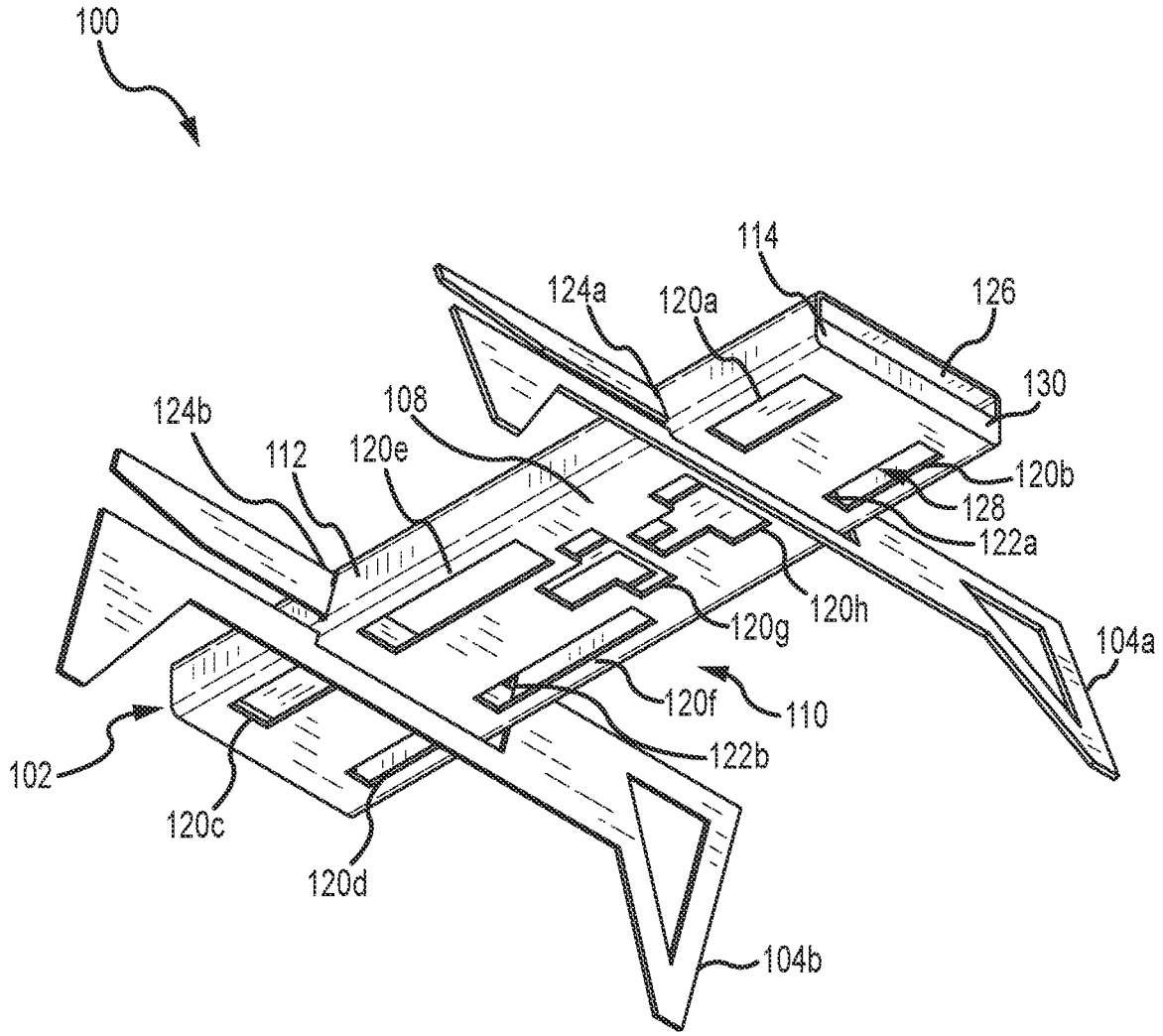
FIG. 2 shows a bottom perspective view of the target stand of FIG. 1.
Figure 3:
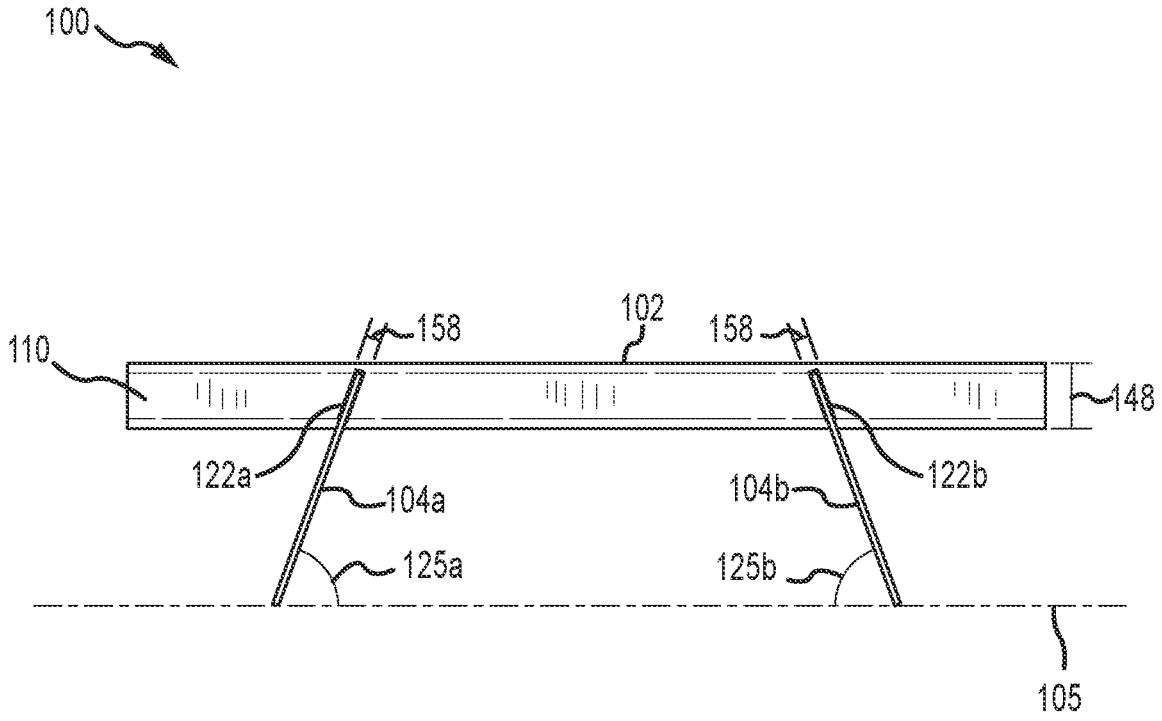
FIG. 3 shows a first side elevation view of the target stand of FIG. 1.
Figure 4:
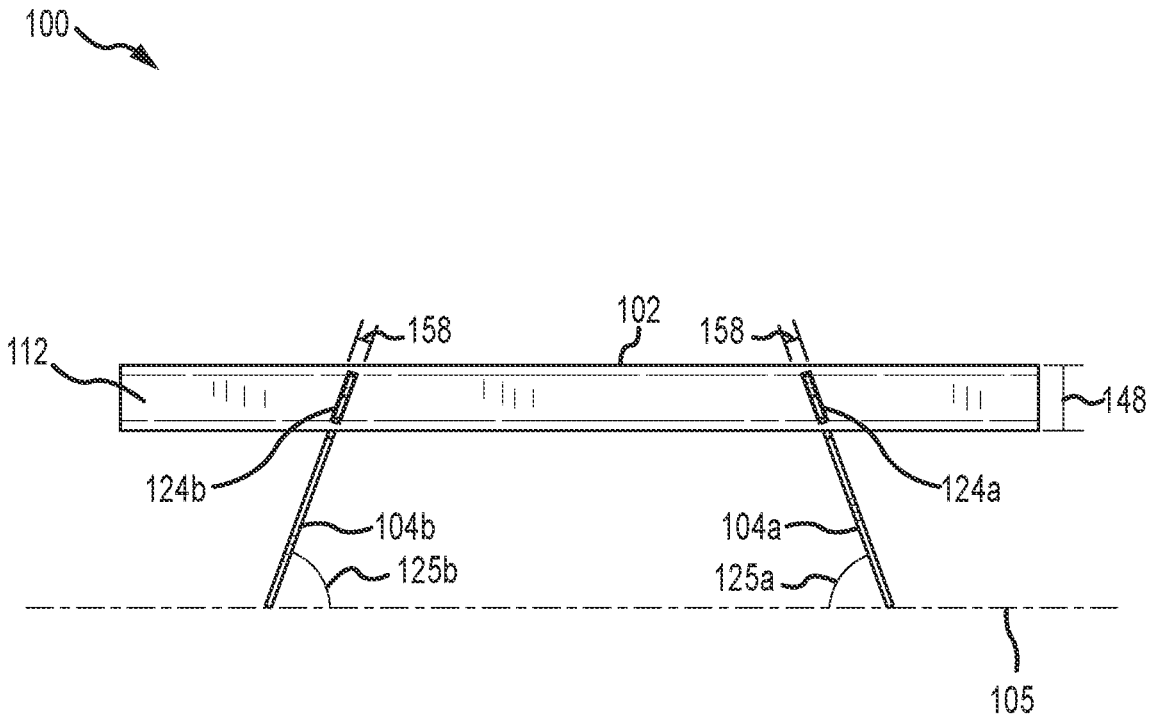
FIG. 4 shows a second side elevation view of the target stand of FIG. 1.
Figure 5:
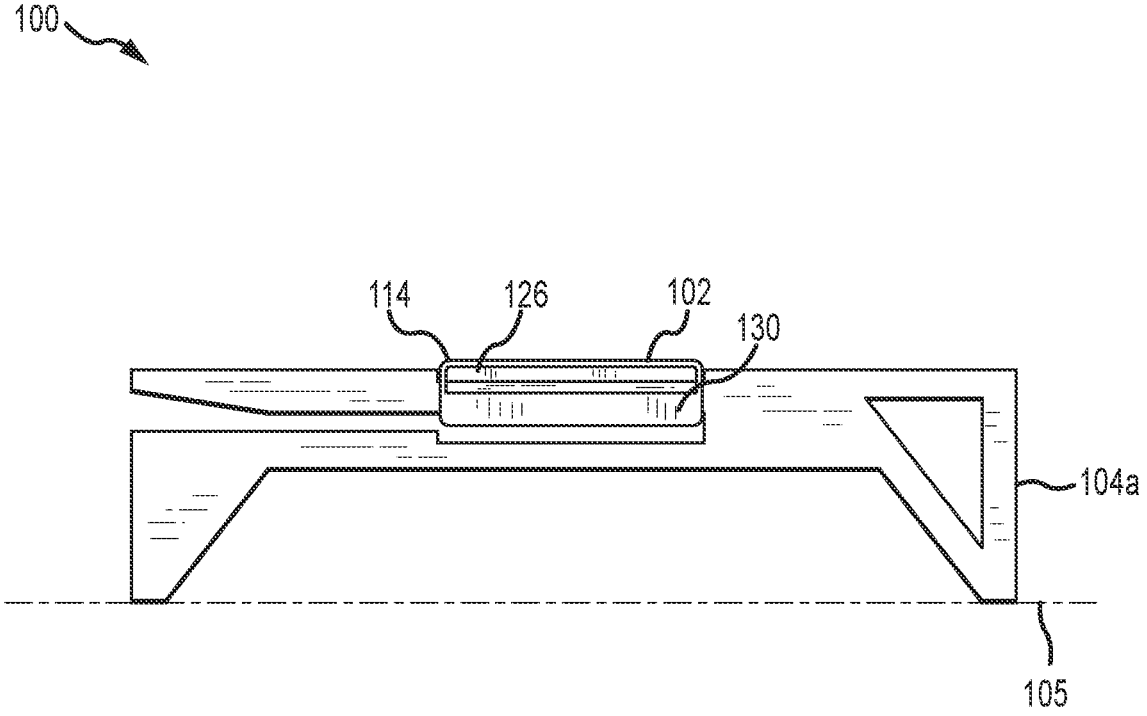
FIG. 5 shows a first end elevation view of the target stand of FIG. 1.
Figure 6:
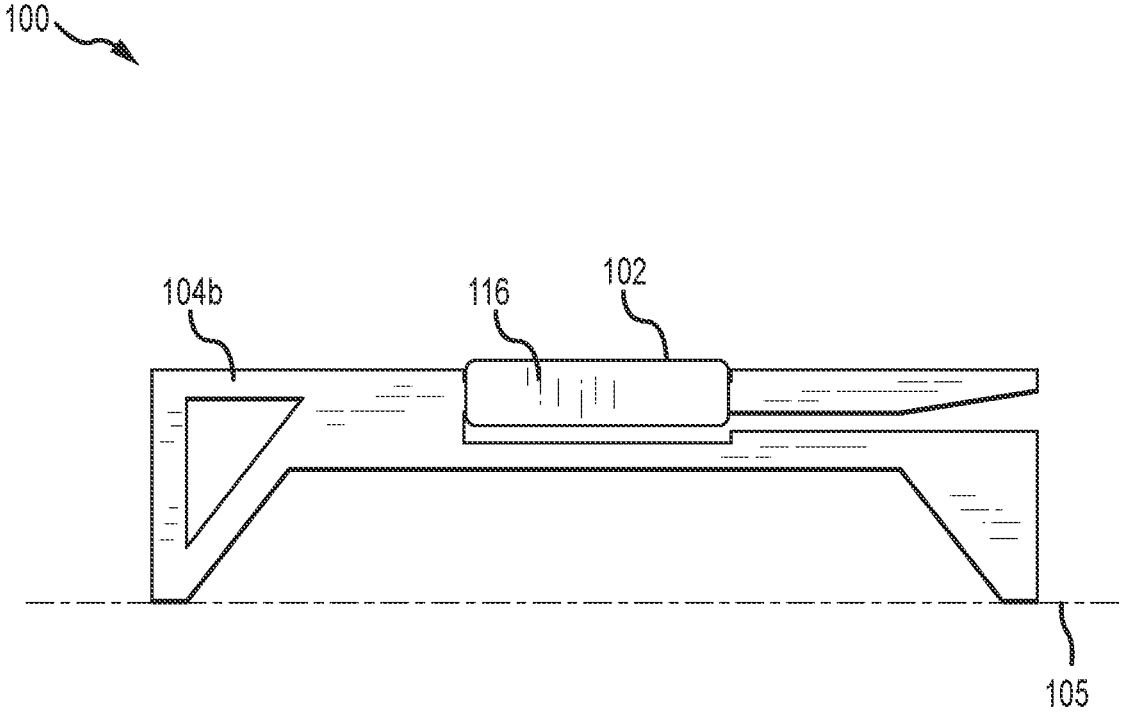
FIG. 6 shows a second end elevation view of the target stand of FIG. 1.
Figure 7:
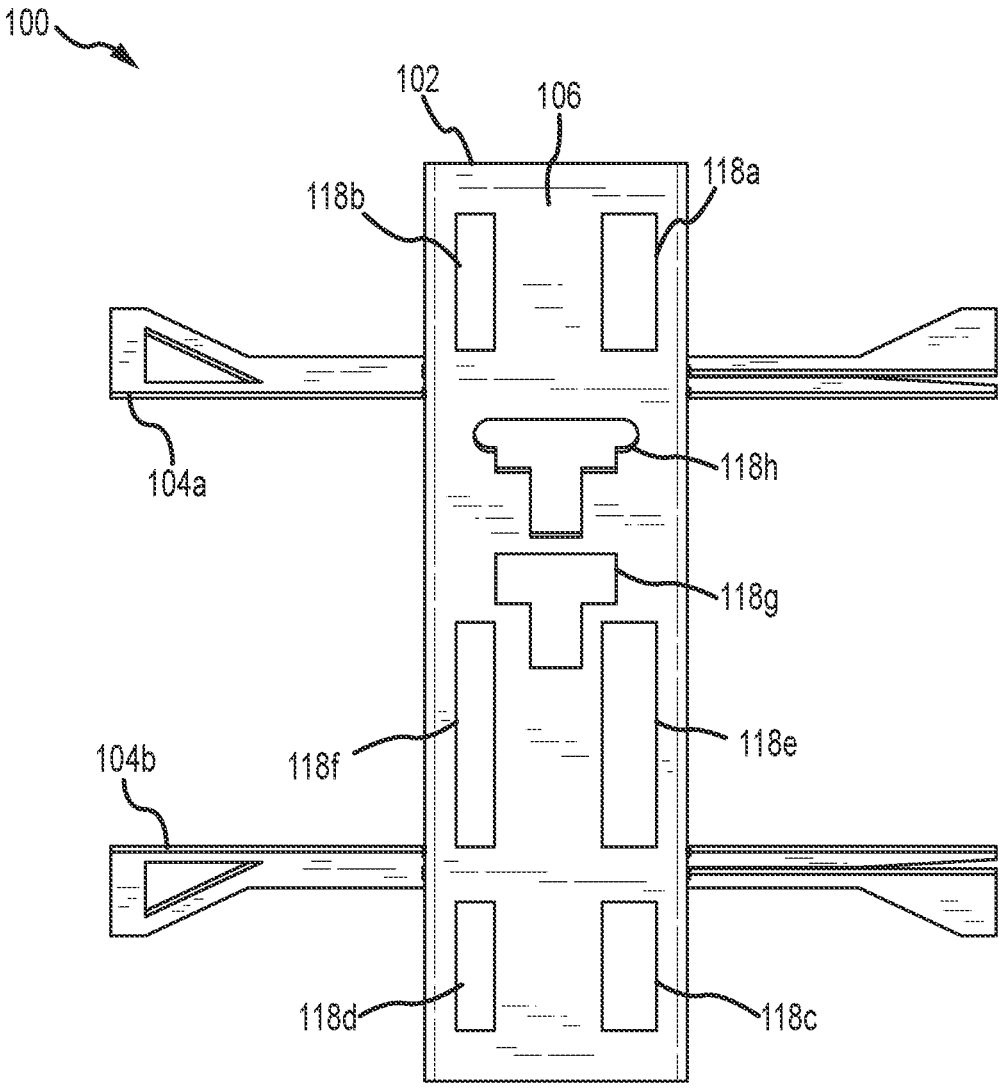
FIG. 7 shows a top plan view of the target stand of FIG. 1.
Figure 8:
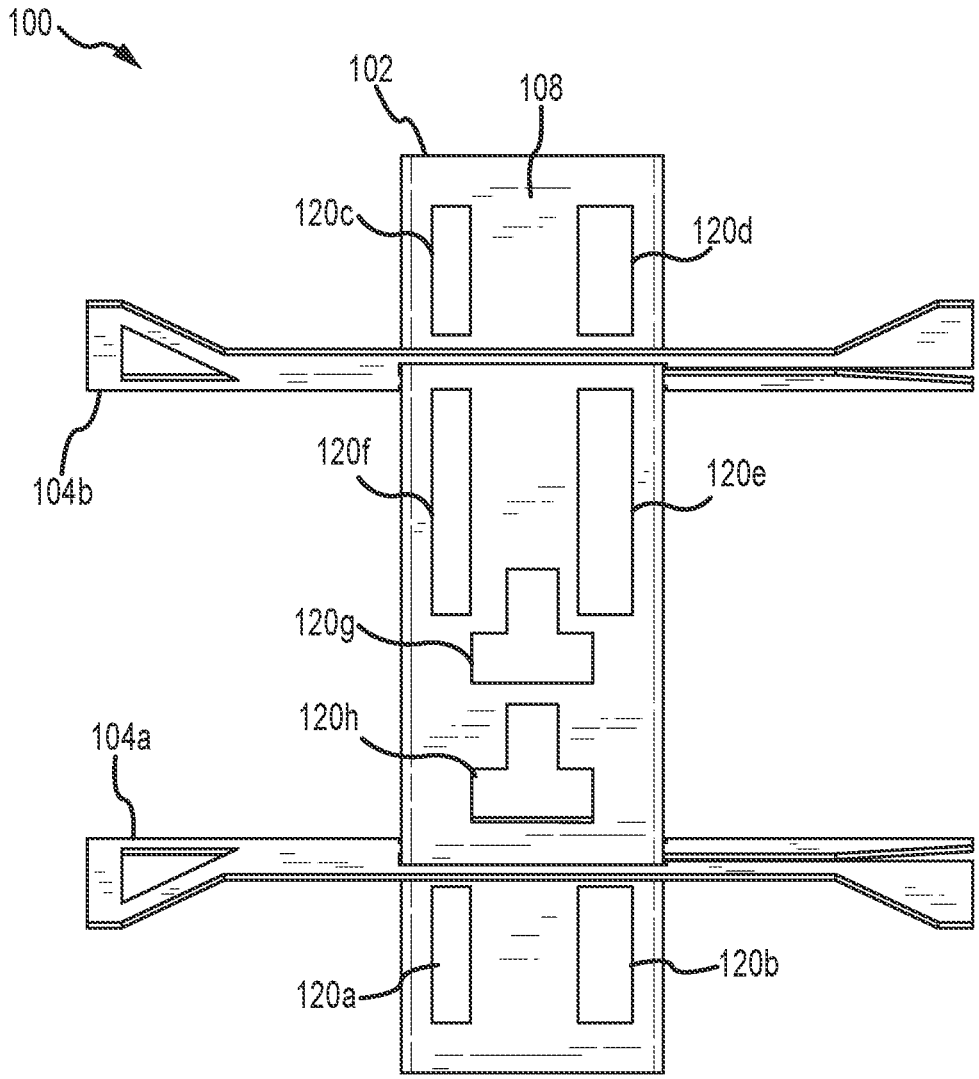
FIG. 8 shows a bottom plan view of the target stand of FIG. 1.

Before any embodiments of the disclosure are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Various aspects of the present disclosure will be described herein with reference to drawings that may be schematic illustrations of idealized configurations.

Known target stands for shooting targets have issues with one or more of size, storability, portability, durability, ease of use, use limitations or restrictions, use during inclement weather, and/or safety. Known target stands may increase stability by increasing size of the target stand and/or the shape of the target stand footprint, which results in increased weight and difficulty of storage or transport. To accommodate at least the increased weight, less robust materials may be used which may negatively affect durability. In addition, known target stands may be designed to be limited or restricted in use with select shooting targets.

It is with respect to the above issues and other problems that the embodiments presented herein were contemplated.

FIGS. 1-10C generally show exemplary views of a collapsible and self-contained target stand 100, in accordance with aspects of the present disclosure. The exemplary target stand 100 includes a main body 102 and at least one stand leg 104. For example, as shown in FIGS. 1-10, the target stand 100 may include two stand legs 104*a*, 104*b*. It is noted, however, the target stand 100 may include or only utilize one stand leg 104 (e.g., in instances where a ground surface 105 requires only one stand leg 104, where a particular angle is desired between the target stand 100 and the ground surface 105 which may be achieved through the use of a single stand leg 104, or the like), without departing from the scope of the present disclosure. In addition, it is noted the target stand 100 may include a main body 102 capable of receiving three or more stand legs 104, without departing from the scope of the present disclosure.

The components of the exemplary target stand 100 (e.g., the main body 102 and the at least one stand leg 104) may be formed from a material including, but not limited to, a metal, a plastic, a wood, a fiberglass, a carbon fiber, or other material capable of being formed into a rigid or semi-rigid structure for the components of the target stand 100. For example, one or more of the components of the target stand 100 may be fabricated from a metal (e.g., including, but not limited to, a steel) to increase one or more of a durability, stability, and/or ease of production or manufacturing of the components of the target stand 100.

The components of the target stand 100 may be fabricated through the use of any fabrication technique including, but not limited to, casting processes (die casting, injection molding, or the like), forming processes (e.g., extrusion, forging, stamping, additive manufacturing processes such as three-dimensional (3D) printing, or the like), cutting processes, joining processes, or the like. It is noted the fabrication processes may occur simultaneously, near-simultaneously, or sequentially where appropriate. In addition, it is noted the fabrication processes may occur separately on unique portions of the components of the target stand 100 (e.g., a bend unique to a particular location on a component, or the like), and/or may be applied to the same portion of the components of the target stand 100 (e.g., extruding or stamping, and then cutting to remove material to form apertures within the extruded or stamped portion, or the like).

In general, the main body 102 may be any three-dimensional shape having a known two-dimensional cross-section. In one instance, an exemplary main body 102 is a cuboid with a rectangular cross-section, which includes a top surface 106, a bottom surface 108 opposite the top surface 106, a first side surface 110, a second side surface 112 opposite the first side surface 110, a first end surface 114, and a second end surface 116 opposite the first end surface 114. One or more of the surfaces of the main body 102 may include apertures.

The first side surface 110 and the second side surface 112 may each be set at an angle to the top surface 106 and/or the bottom surface 108. For instance, the first side surface 110 and the second side surface 112 may each be perpendicular or approximately perpendicular to the top surface 106 and/or the bottom surface 108.

The first end surface 114 and the second side surface 116 may each be set at an angle to the top surface 106 and/or the bottom surface 108. For instance, the first end surface 114 and the second side surface 116 may each be perpendicular or approximately perpendicular to the top surface 106 and/or the bottom surface 108.

The first side surface 110 and the second side surface 112 may each be set at an angle to the first end surface 114 and/or the second end surface 116. For instance, the first side surface 110 and the second side surface 112 may each be perpendicular or approximately perpendicular to the first end surface 114 and/or the second end surface 116.

It is noted, however, the various angles described above may be any angle without departing from the scope of the present disclosure. For example, any or all of the various angles may range from between 0 degrees to 180 degrees, to the extent the one or more surfaces of the main body 102 are able to intersect and/or align.

In one non-limiting example, the top surface 106 may include one or more top support member apertures 118 dimensioned to receive a support member for a shooting target when the target stand 100 is in an assembled state. In one instance, an exemplary top surface 106 includes top support member apertures 118*a*, 118*b*, 118*c*, 118*d*, 118*e*, 118*f*, 118*g*, and 118*h*. In another non-limiting example, the bottom surface 108 includes one or more bottom support member apertures 120 dimensioned to receive a support member for a shooting target when the target stand 100 is in an assembled state. In one instance, an exemplary bottom surface 108 includes bottom support member apertures 120*a*, 120*b*, 120*c*, 120*d*, 120*e*, 120*f*, 120*g*, and 120*h*.

The support member apertures 118, 120 may be aligned, allowing for the passage of a support member of a shooting target (e.g., as shown in FIGS. 11-16C and described herein) through the top surface 106 and the bottom surface 108. It is noted, however, the support member apertures 118, 120 may be unaligned, such that a support member passing through a support member aperture 118 makes contact with material of the bottom surface 108 between or proximate to a support member aperture 118. In general, it should be understood the top surface 106 and/or the bottom surface 108 may include any number of respective support member apertures 118, 120 without departing from the scope of the present disclosure.

The support member apertures 118, 120 may be any polygonal two-dimensional shape known in the art with any dimensions, without departing from the scope of the present disclosure. For example, the support member apertures 118 on the top surface 106 and/or the support member apertures 120 may be different in size relative to at least one other support member aperture 118 on the top surface 106 and/or support member aperture 120 on the bottom surface 108. By way of another example, the support member apertures 118 on the top surface 106 and/or the support member apertures 120 on the bottom surface 108 may be the same size relative to other support member apertures 118 on the top surface 106 and/or support member apertures 120 on the bottom surface 108. For instance, a first subset of the support member apertures 118, 120 may be a first shape with a first set of dimensions and a second subset of the support member apertures 118, 120 may be a second shape with a second set of dimensions, where the first shape and the second shape may be the same or different, without departing from the scope of the present disclosure. In this regard, the target stand 100 may be usable for multiple different types or designs of a shooting target, as shown in FIGS. 11-16D and described herein.

In another non-limiting example, the first side surface 110 may include one or more first side stand leg apertures 122 dimensioned to receive a stand leg 104 when the target stand 100 is in an assembled state. In one instance, an exemplary first side surface 110 includes first side stand leg apertures 122*a* and 122*b*. In another non-limiting example, the second side surface 112 includes one or more second side stand leg apertures 124 dimensioned to receive a stand leg 104 when the target stand 100 is in an assembled state. In one instance, an exemplary second side surface 112 includes second side stand leg apertures 124*a* and 124*b*.

It is noted the support member apertures 122, 124 may be aligned, allowing for the passage of a stand leg member 104 through the first side surface 110 and the second side surface 112. In general, it should be understood the first side surface 110 and/or the second side surface 112 may include any number of respective stand leg apertures 122, 124 without departing from the scope of the present disclosure.

The support member apertures 122, 124 may be set at an angle of insertion 125, which positions the at least one stand leg 104 at a desired angle relative to the ground surface 105. For example, the angle of insertion 125 may range between 0 degrees and 180 degrees. For instance, the angle of insertion 125 may be less than 90 degrees, greater than 90 degrees, or be perpendicular or substantially perpendicular relative to the ground surface 105. In one non-limiting example, where there are multiple stand legs 104*a*, 104*b*, an angle of insertion 125*a* may be less than 90 degrees and an angle of insertion 125*b* may be greater than 90 degrees. The angles of insertion 125*a*, 125*b* may be (but are not limited to being) equal and opposite, or substantially equal and opposite.

It is noted the present disclosure is not limited to the orientation or configuration of the stand legs 104 relative to the main body 102 including, but not limited to, the angle of insertion 125 relative to the ground surface 105, the direction or order of insertion within the first side surface 110 and second side surface 112, and the like, and that other orientations or configurations are possible without departing from the scope of the present disclosure. For example, the stand legs 104 may be inserted in the second side surface 112 before the first side surface 110, without departing from the scope of the present disclosure. By way of another example, the stand leg apertures 122, 124 may be cut within the side surfaces 110, 112 such that the stand legs 104 may be orientated at a different angle that than exemplarily shown in FIGS. 1-16D, without departing from the scope of the present disclosure.

In another non-limiting example, the first end surface 114 may include one or more end apertures 126. The one or more end apertures 126 may be dimensioned to receive the stand legs 104. The one or more end apertures 126 may provide access to a main body cavity 128 defined by one or more of the surfaces of the main body 102. For example, the stand legs 104 may be inserted within the one or more end apertures 126 to be stored within the main body cavity 128 when the target stand 100 is in a collapsed state. For instance, the end surface aperture 126 may have a height that is at least a thickness 158 of the stand leg 104, to allow for passage of the entire stand leg 104 into the cavity 128.

An end surface portion 130 of the first end surface 114 may prevent the removal or exit of the stand legs 104 from within the cavity 128, unless the main body 102 is in a particular orientation and/or unless a force is applied to the stand legs 104 through one or more of the apertures 118, 120, 122, 124. For example, the end surface portion 130 may have a height that is at least the thickness 158 of the stand leg 104, to prevent the removal or exiting of the stand leg 104 from the cavity 128 unless the main body 102 is in a particular orientation and/or unless a force is applied to the stand legs 104 through one or more of the apertures 118, 120, 122, 124.

It is noted the present disclosure is not limited to the location of the one or more end apertures 126 within the first end surface 114, and that other locations or configurations are possible without departing from the scope of the present disclosure. For example, the end apertures 126 may be positioned in the second end surface 116, without departing from the scope of the present disclosure. By way of another example, the end apertures 126 may be positioned in either side surface 110, 112, to the extent the end apertures 126 do not interfere with the engagement of the stand legs 104 with the main body 102 via the stand leg apertures 122, 124 in the respective side surfaces 110, 112, without departing from the scope of the present disclosure.

Referring now to FIGS. 1 and 9A-9F, the transition of the target stand 100 between an assembled state and a collapsed state is shown, in accordance with aspects of the present disclosure.

In the assembled state shown in FIG. 1, stand leg 104*b* is fully installed in the side stand leg apertures 122*b*, 124*b* in the main body 102. Stand leg 104*a* is similarly fully installed in the side stand leg apertures 122*a*, 124*a* of the main body 102.

Figure 9A:
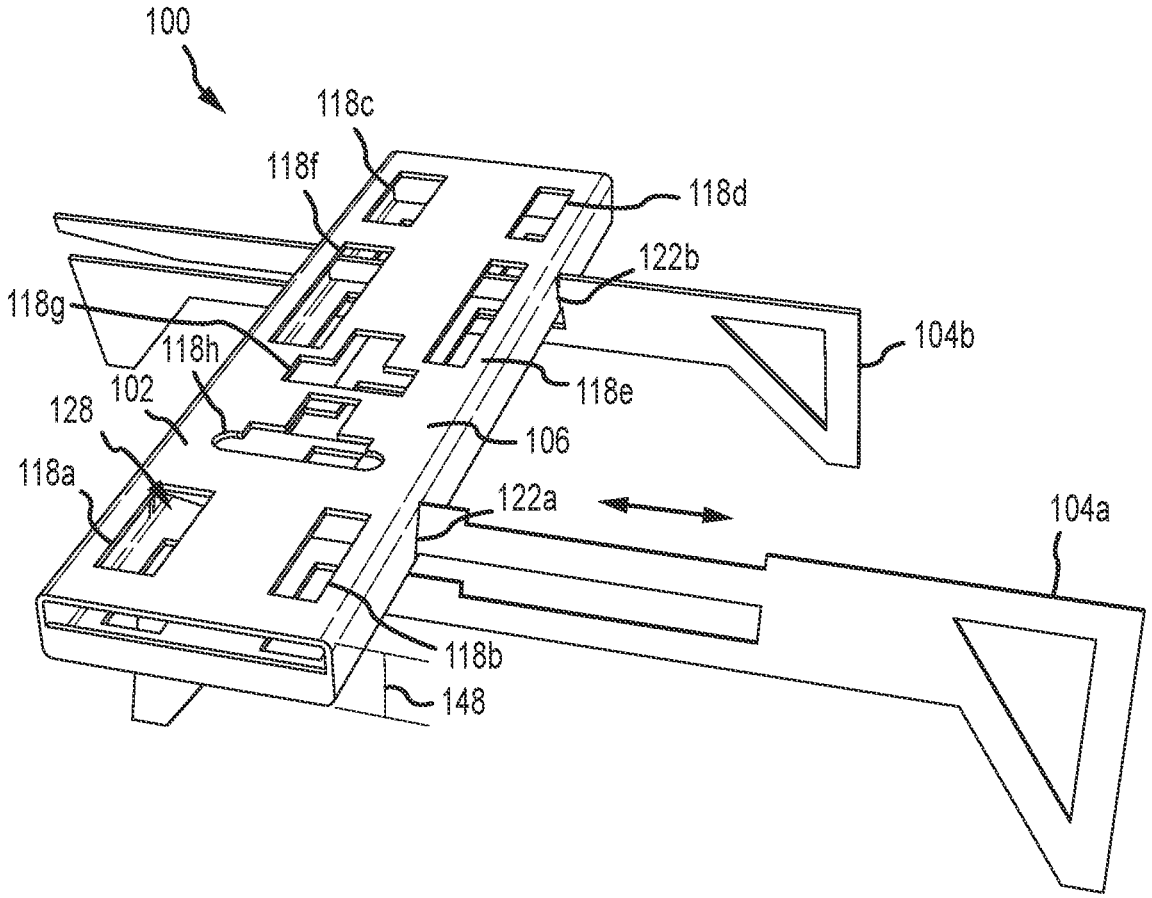
FIG. 9A shows the target stand of FIG. 1 in a transition state with the two legs being inserted or removed from the main body, in accordance with aspects of the present disclosure.

In a first transition state shown in FIG. 9A, stand leg 104*b* is fully installed in the side stand leg apertures 122*b*, 124*b* in the main body 102, while stand leg 104*a* is being installed or removed from the side stand leg apertures 122*a*, 124*a* of the main body 102. Stand leg 104*b* may be similarly installed or removed from the side stand leg apertures 122*b*, 124*b* of the main body 102, either simultaneously, substantially simultaneously, or sequentially with the removal of the stand leg 104*a*.

Figure 9B:
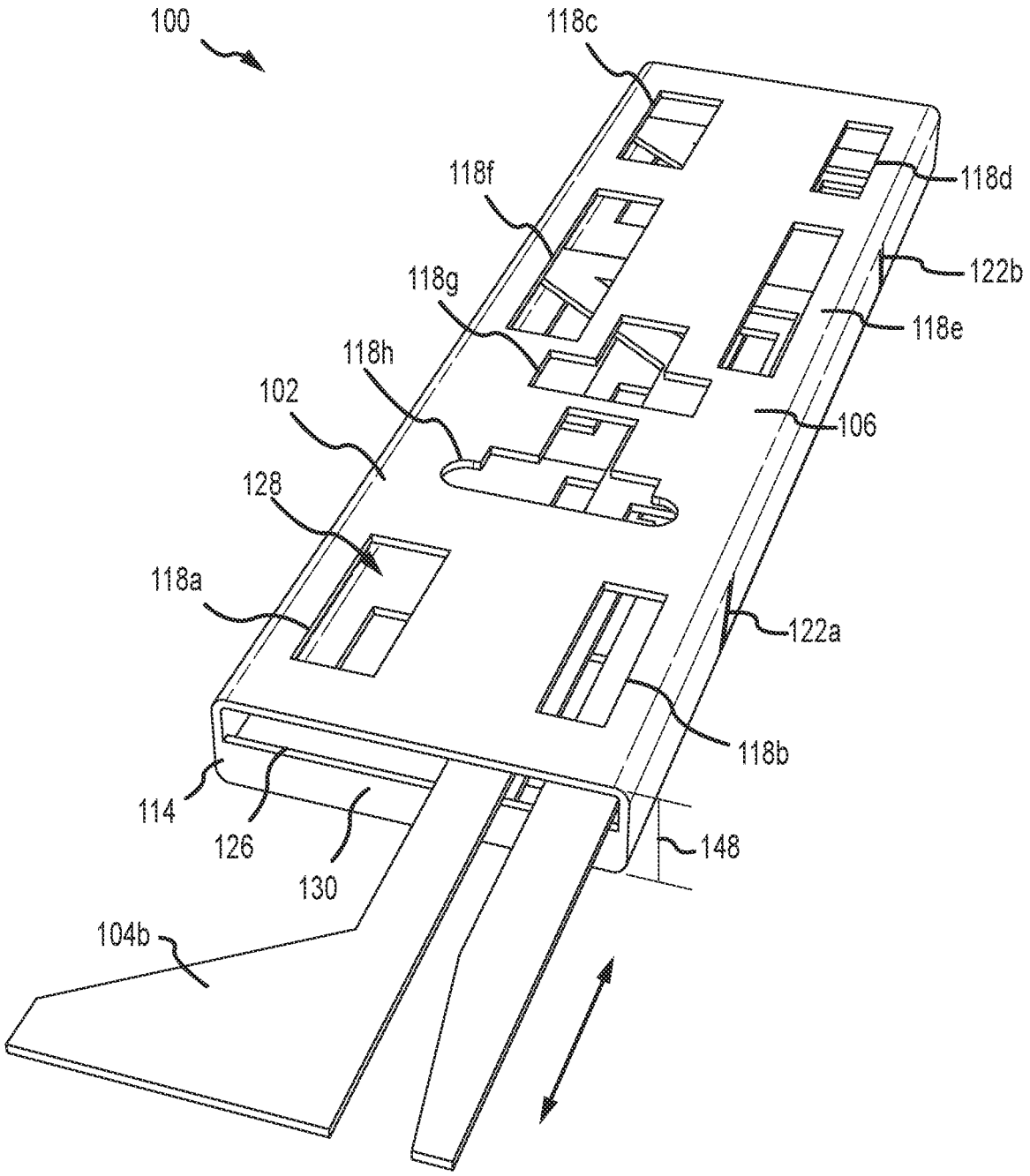
FIG. 9B shows the target stand of FIG. 9A in a transition state with the two legs being inserted or removed from a cavity defined in the main body, in accordance with aspects of the present disclosure.
Figure 9C:
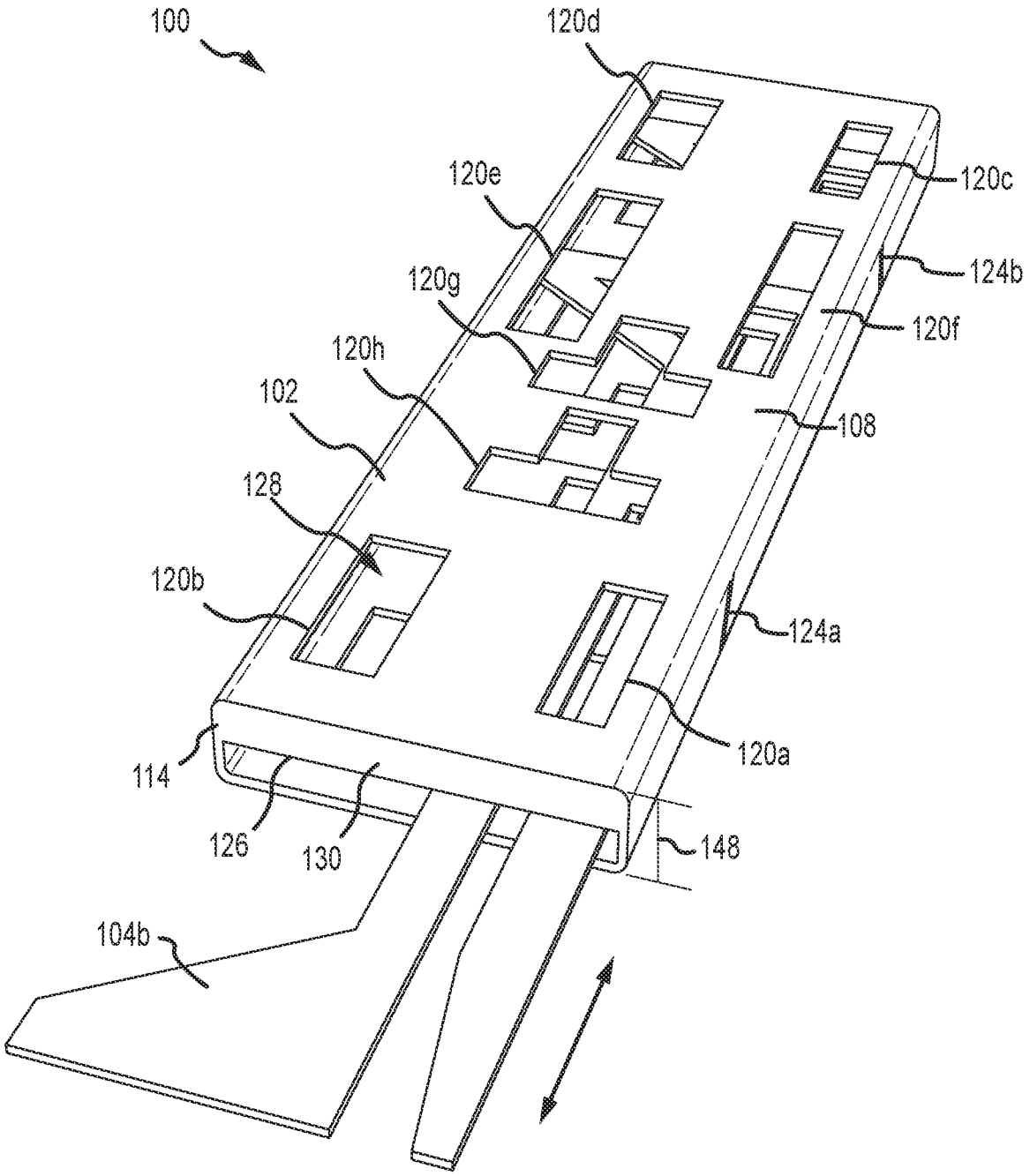
FIG. 9C shows the target stand of FIG. 9A in a transition state with the two legs being inserted or removed from a cavity defined in the main body, in accordance with aspects of the present disclosure.

In a second transition state shown in FIGS. 9B and 9C, stand leg 104*a* is fully inserted in the main body cavity 128 defined within the main body 102, while stand leg 104*b* is being inserted or removed from the main body cavity 128 defined within the main body 102. Stand leg 104*b* may be similarly installed or removed from the main body 102, either simultaneously, substantially simultaneously, or sequentially with the removal of the stand leg 104*b*. It is noted FIG. 9B shown the top surface 106 upright, while FIG. 9C shows the bottom surface 108 upright. Where the top surface 106 is upright, the stand legs 104*a*, 104*b* may be inserted into the first end aperture 126 and drop into the cavity 128, and the end surface portion 130 holds the stand legs 104*a*, 104*b* in place within the cavity 128. In addition, where the bottom surface 108 is upright, the stand legs 104*a*, 104*b* may be slid in and out of the cavity 128 via the aperture 126, without interference from the end surface portion 130.

Figure 9D:
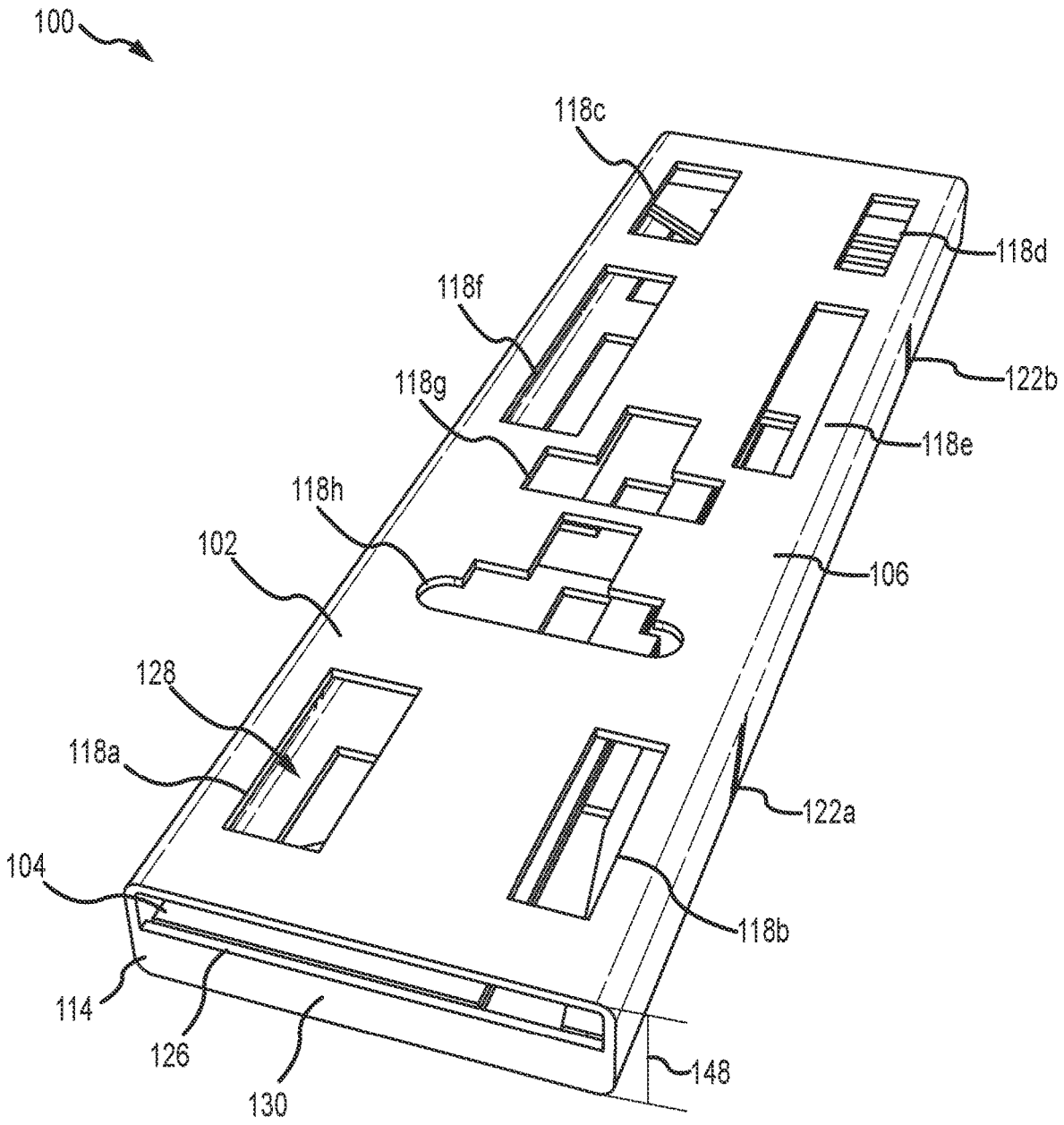
FIG. 9D shows the target stand of FIG. 9B or FIG. 9C in a collapsed state with the two legs housed within the cavity defined by the main body, in accordance with aspects of the present disclosure.

In the collapsed state shown in FIG. 9D, stand leg 104*b* is fully installed in the main body cavity 128 defined within the main body 102. Stand leg 104*a* is similarly fully installed in the main body cavity 128 defined within the main body 102.

Figure 9E:
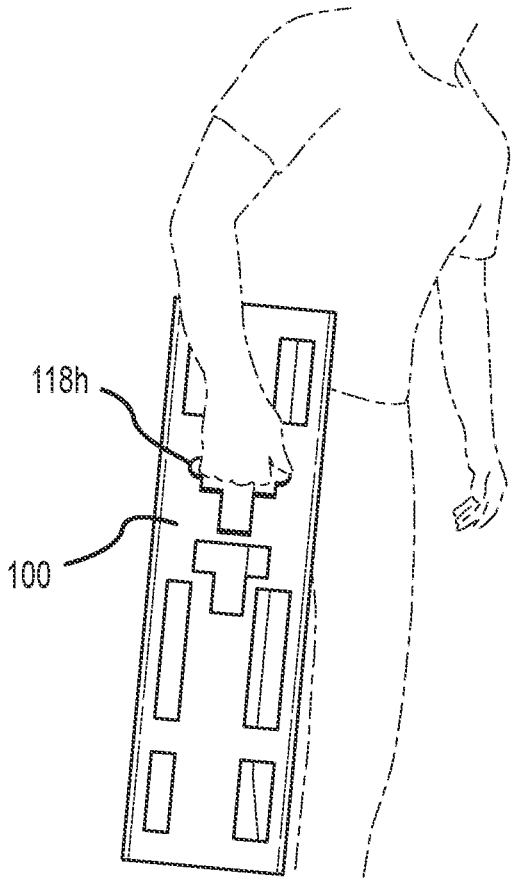
FIG. 9E shows the target stand of FIG. 9D being carried by a user during transport, in accordance with aspects of the present disclosure.

As shown in one non-limiting example in FIG. 9E, a user may interact with the target stand 100 via a support member aperture 118, 120. In one non-limiting example, the user may insert a hand into the top support member aperture 118*h* to lift the target stand 100 while in the collapsed state during transport and/or storage. It is noted, however, that any support member aperture 118, 120 may be used, without departing from the scope of the present disclosure. In addition, it is noted that the support member apertures 118, 120 (e.g., the top support member aperture 118*h*, or the like) may be used to position the target stand 100 when in the assembled state, without departing from the scope of the present disclosure.

Figure 9F:
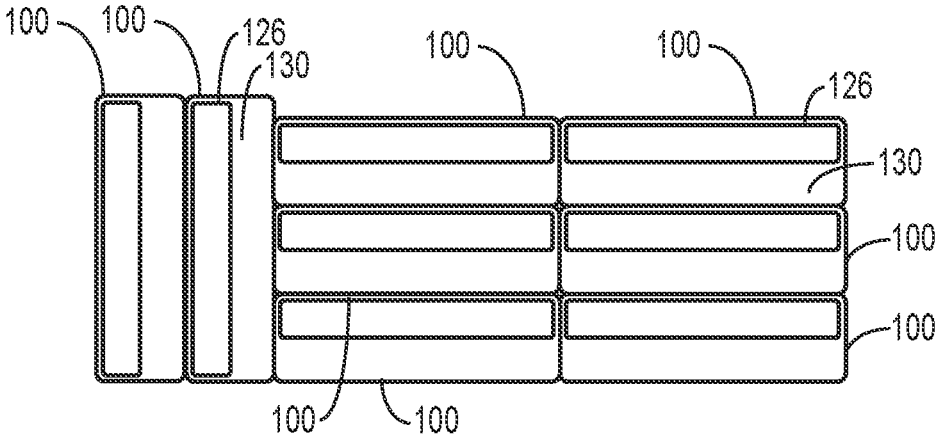
FIG. 9F shows the target stand of FIG. 9D in a stacked configuration for storage or transport, in accordance with aspects of the present disclosure.

As shown in one non-limiting example in FIG. 9F, multiple target stands 100 may be stacked or otherwise arranged during transport and/or storage. It is noted, however, that the multiple target stands 100 may be stacked or otherwise arranged in a different configuration than that shown in FIG. 9F, without departing from the scope of the present disclosure. In general, due to the compact size and self-contained nature of the target stand 100 when in the collapsed state, the amount of space necessary to store the target stands 100 is greatly reduced from known target stands.

Figure 10A:
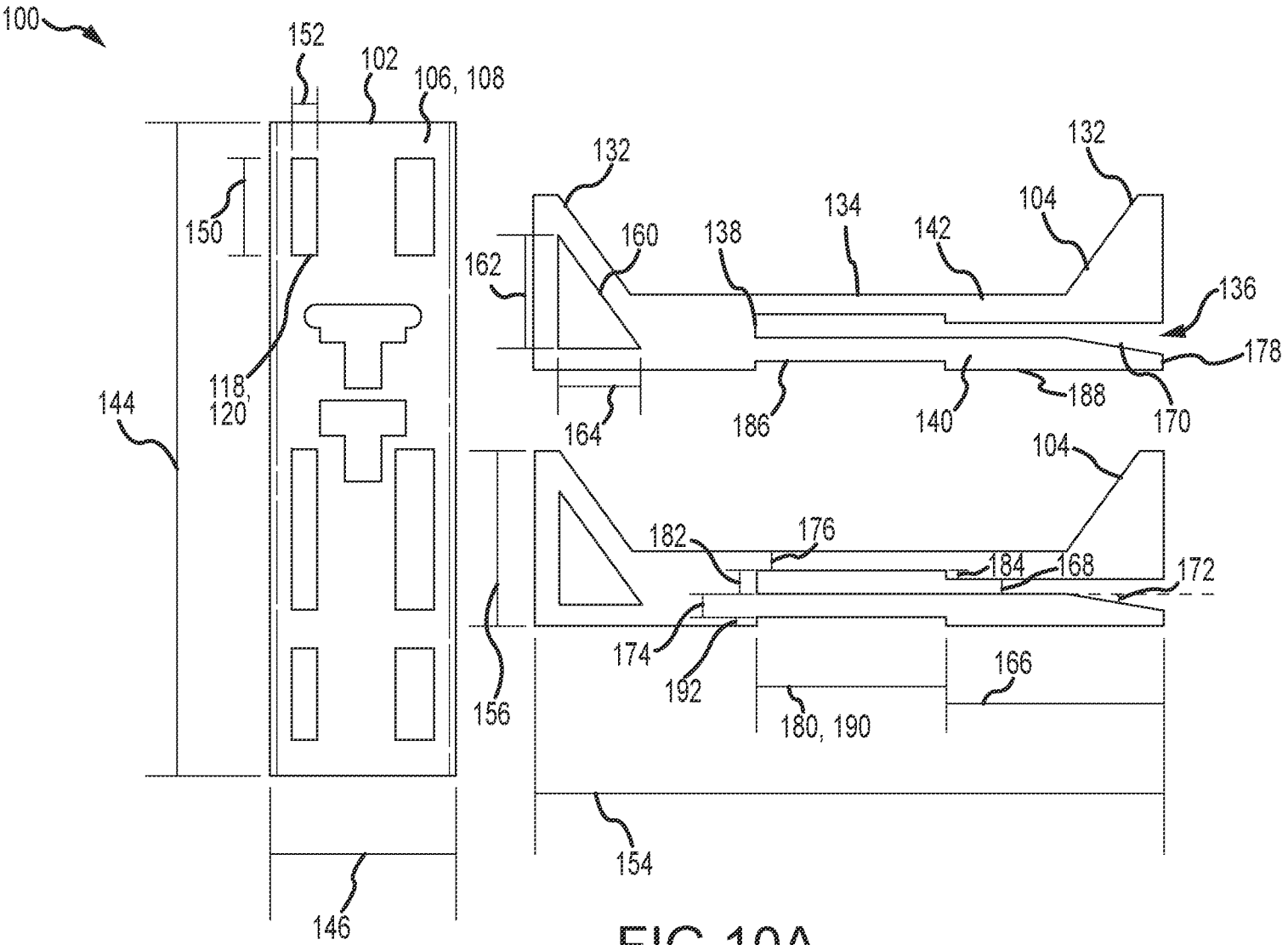
FIG. 10A shows the target stand of FIG. 1 in a disassembled state with the two legs uncoupled from the main body, in accordance with aspects of the present disclosure.

Referring now to FIG. 10A, an exemplary stand leg 104 includes one or more stand risers 132 affixed to a stand body 134. For example, an exemplary stand leg 104 includes two stand risers 132 positioned proximate to opposite ends of the stand body 134. The stand risers 132 may be formed with the stand body 134. Alternatively or in addition, one or more of the stand risers 132 may be affixed to the stand body 134 via one or more joining process.

Figure 16A:
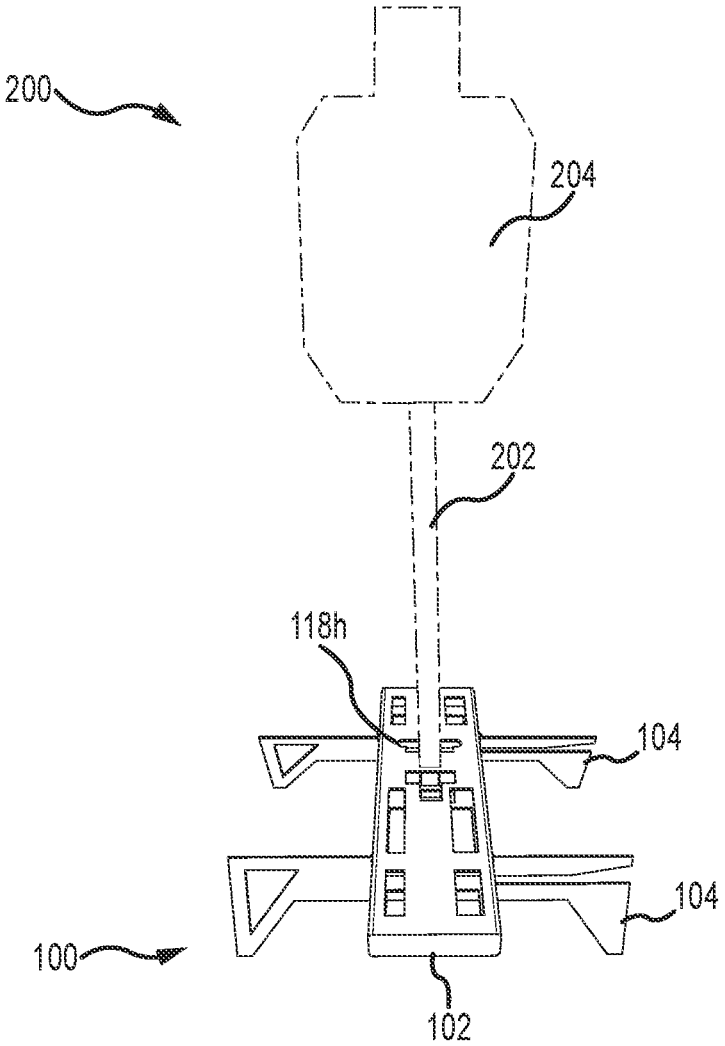
FIG. 16A shows the system of FIG. 15 with the target stand of FIG. 1 and the shooting target.
Figure 16B:
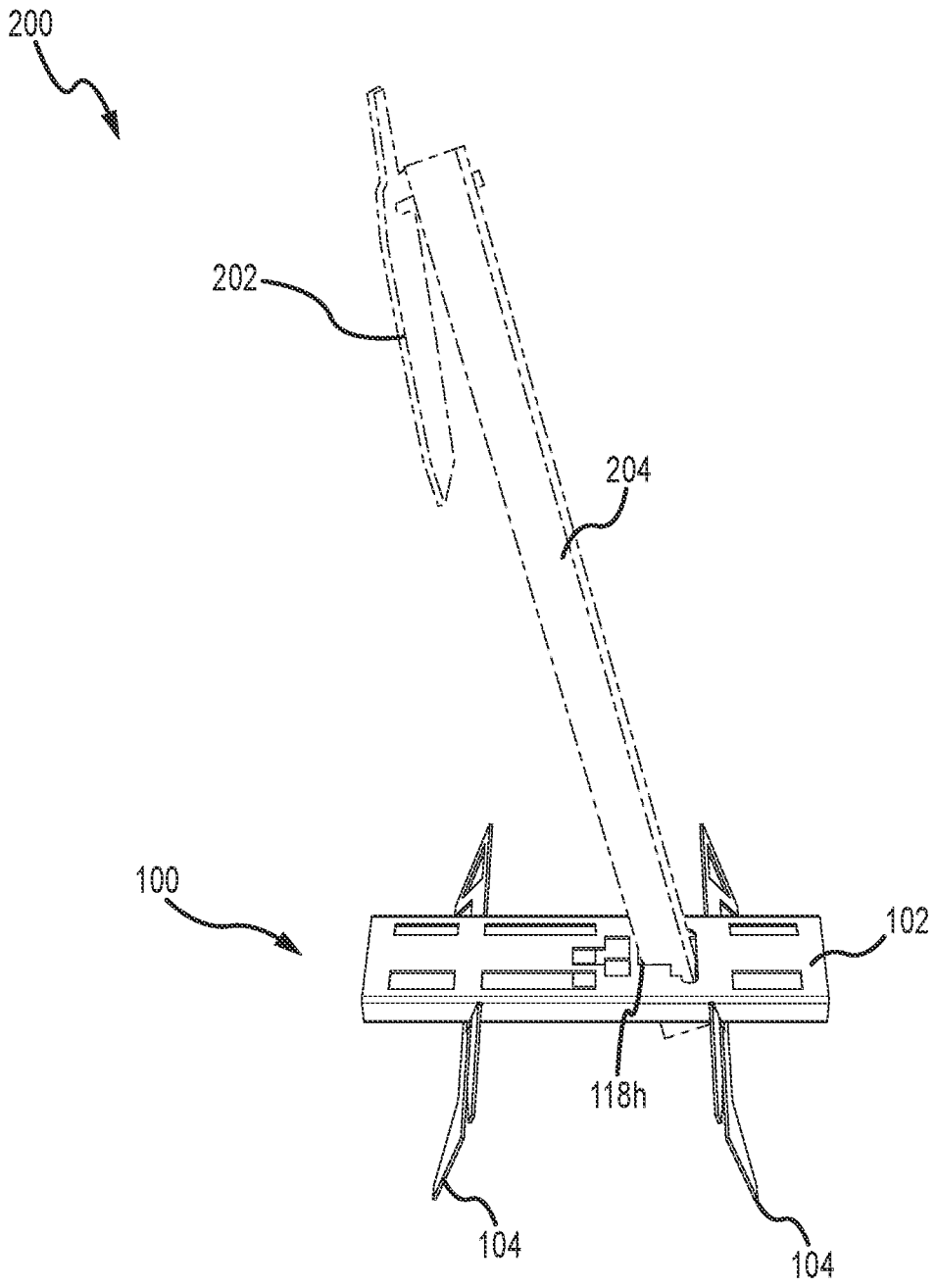
FIG. 16B shows the system of FIG. 16A with the target stand of FIG. 1 and the shooting target.
Figure 16C:
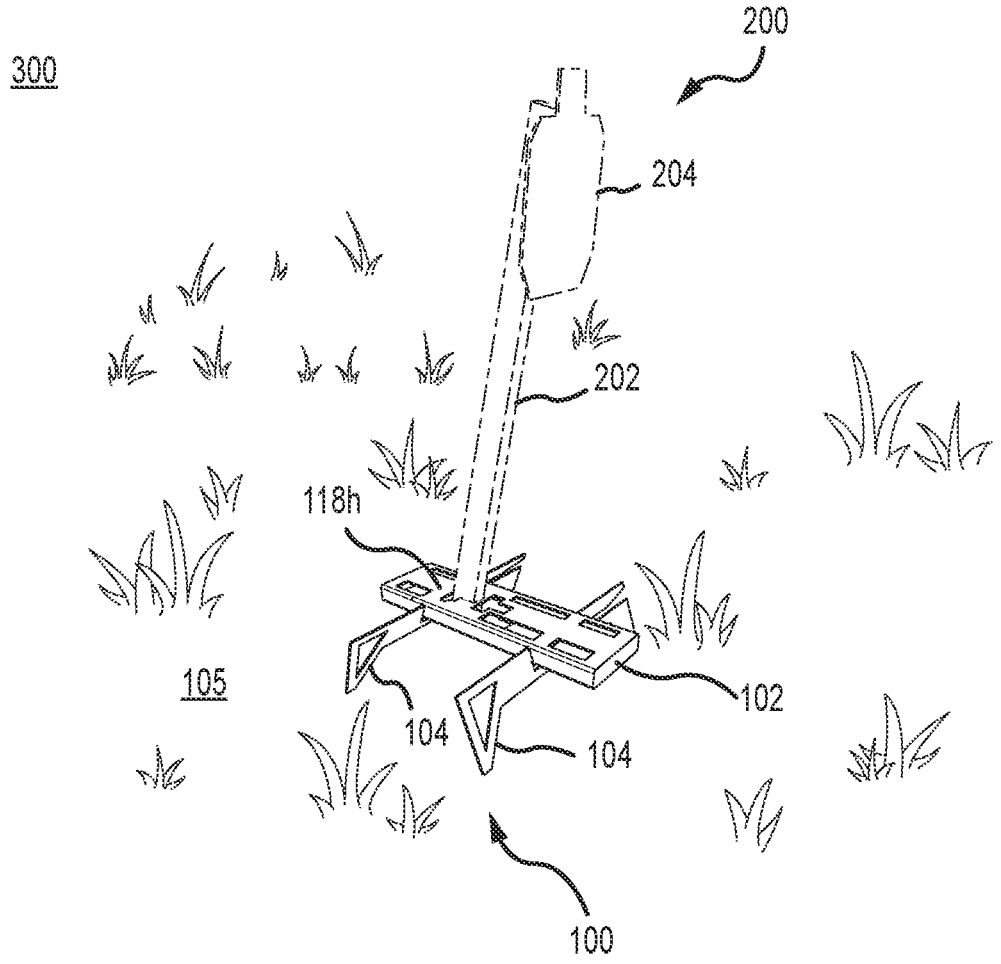
FIG. 16C shows the system of FIG. 16A with the target stand of FIG. 1 and the shooting target in an environment with a hard-packed ground surface.
Figure 16D:
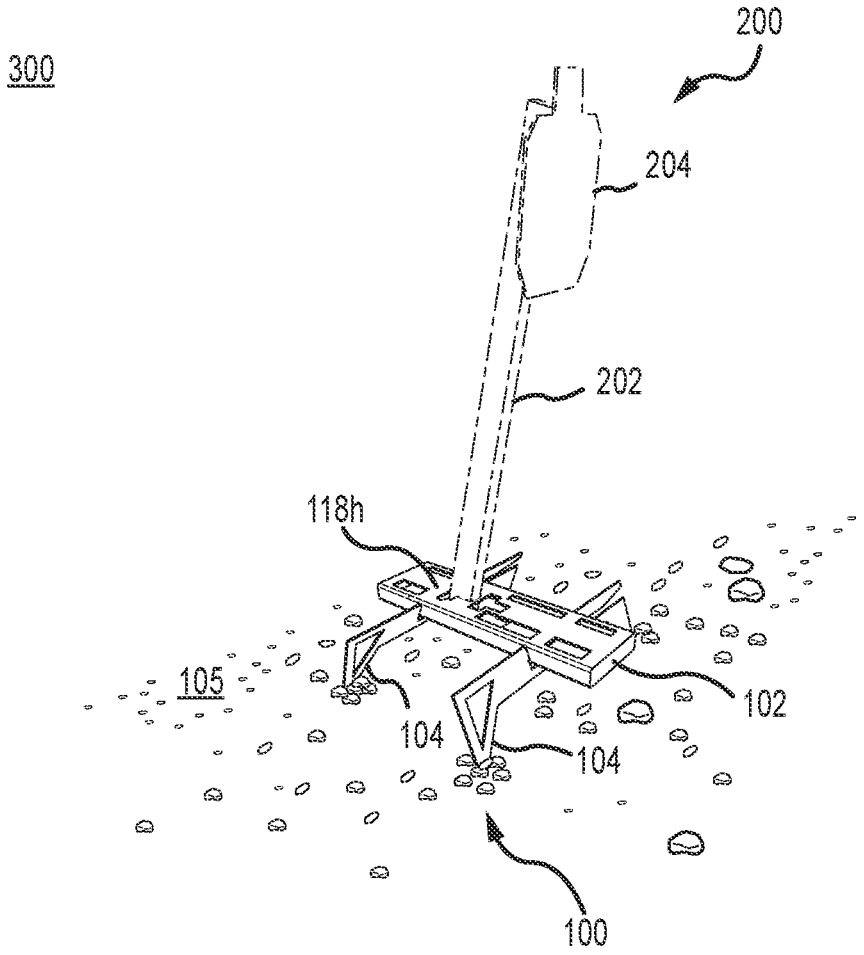
FIG. 16D shows the system of FIG. 16A with the target stand of FIG. 1 and the shooting target in an environment with a soft-packed ground surface.

It is noted the at least one stand riser 132 may have a distal end which is flat, substantially flat, or come to a point depending on an environment 300 including the ground surface 105 in which the target stand 100 may be utilized. For example, as shown in FIG. 16C, the at least one stand riser 132 being flat or substantially flat at the distal end may allow the target stand 100 to better disperse weight across a hard-packed ground surface 105, allowing for increased stability in combination with the low-profile of the target stand 100. By way of another example, as shown in FIG. 16D, the at least one stand riser 132 coming to a point at the distal end may allow the stand riser 132 to at least partially embed in a soft or soft-packed ground surface 105 (e.g., soil, sand, gravel, or the like), allowing for increased stability of the target stand 100.

An exemplary stand body 134 includes a stand body channel 136 that leads to a stand body cavity 138. The stand body channel 136 and the stand body cavity 138 separates at least a portion of the stand body 134 into a first stand body section 140 and a second stand body section 142. For example, as shown in FIGS. 1-9C, the first stand body section 140 is insertable into the main body 102 via the first side stand leg apertures 122, passes through the main body cavity 128, and exits the main body 102 via the second side stand leg apertures 124. It is noted the first stand body section 140 is insertable in the opposite direction without departing from the scope of the present disclosure. By way of another example, at least one of the one or more stand risers 132 are proximate to the second stand body section 142, and the second stand body section 142 is proximate to the bottom surface 108 (e.g., positioned underneath) the main body 102 when the at least one stand leg 104 is inserted into the main body 102. For instance, the bottom surface 108 is proximate to and/or makes contact with the second stand body section 142 when the at least one stand leg 104 is inserted into the main body 102.

The main body 102 has at least one main body length 144, at least one main body width 146, and at least one main body thickness 148. The support member apertures 118, 120 have various lengths 150 and/or widths 152 which make up a portion of the main body length 144 and/or main body width 146, respectively. For example, a first support member aperture 118 and/or 120 may be a first shape with a first set of dimensions having at least a first length 150 and at least a first width 152. By way of another example, a second support member aperture 118 and/or 120 may be a second shape with a second set of dimensions having at least a second length 150 and at least a second width 152. It is noted the support member aperture lengths 150 and/or support member aperture widths 152 may be the same for each support member aperture 118 and/or 120, different for at least one of the support member apertures 118 and/or 120, or different for every support member aperture 118 and/or 120. In addition, it is noted the support member aperture lengths 150 and/or support member aperture widths 152 may have perimeters which are straight or substantially straight, and/or may include at least a portion or section of the perimeter which is curved or generally arcuate.

It is noted the support member apertures 118, 120 may provide added benefit in terms of weight reduction and/or part interaction by a user, without reducing the stability or robustness of the target stand 100 as a whole. As one feature of the present disclosure, at least one of the support member apertures 118, 120 may be of a length or width that may allow for increased ease of interaction by a user to insert their hand and lift or move the target stand 100 during relocation (e.g., in an assembled state), during transportation (e.g., in an assembled state, or in a collapsed state) and/or when placing in or removing from storage (e.g., in a collapsed state).

The at least one stand leg 104 has at least one stand leg length 154, at least one stand leg width 156, and at least one stand leg thickness 158. In general, due to the arrangement of the main body 102 at the at least one stand leg 104 when the target stand 100 is in the assembled state, the at least one stand leg length 154 may be greater than the at least one main body width 146, and the at least one stand length width 156 may be greater than the at least one main body thickness 148. In this regard, a support member of a shooting target may be insertable into the main body 102, pass through support member apertures 118, 120, and travel an additional distance downward before making contact with the ground surface 105 due to the increased height of the target stand 100 afforded by the stand risers 132 below the main body 102 and the stand body 134 which promotes stability and robustness of a complete shooting target and target stand system (e.g., as shown in FIGS. 11-16D).

At least a portion of the at least one stand leg 104 may include at least one stand leg cutout 160. For example, the at least one stand leg cutout 160 may be at least partially positioned within the one or more stand risers 132 and/or the stand body 134. The stand leg cutout 160 has at least one cutout length 162 and at least one cutout width 164 which make up a portion of the stand leg length 154 and/or stand leg width 156, respectively. Where there are multiple stand leg cutouts 160, the stand leg cutout lengths 162 and/or stand leg cutout widths 164 may be the same for each stand leg cutout 160, different for at least one of the stand leg cutouts 160, or different for every stand leg cutout 160. It is noted the stand leg cutouts 160 may provide added benefit in terms of weight reduction and/or component interaction by a user, without reducing the stability or robustness of the target stand 100 as a whole.

The stand body channel 136 has at least one stand body channel length 166 and at least one stand body channel width 168 along at least a portion of the stand body channel 136. For example, the stand body channel 136 has a single stand body channel length 166 and a single stand body channel width 168 along the entire stand body channel 136. By way of another example, the stand body channel 136 has a first stand body channel length 166 and a first stand body channel width 168 along a first portion of the stand body channel 136. In this example, the stand body channel 136 has a sloped channel edge 170 in a second portion of the stand body channel 136, where the sloped channel edge 170 is set at a channel edge angle 172, which increases the stand body channel 136 from the first stand body channel width 168 to a second stand body channel width 168. It is noted this increase of width 168 may result in a decrease of a first stand body section width 174 and/or a second stand body section width 176. For instance, the decreasing of the width of the first stand body section width 174 may occur at a distal end 178 of the first stand body section 140 which is inserted into the side stand leg apertures 122, 124, resulting in the distal end 178 coming to a point or a narrowed section. This decrease may assist in the alignment and insertion of the stand leg 104 (and exemplarily the first stand body section 140) into the side stand leg apertures 122, 124.

The stand body cavity 138 has at least one stand body cavity length 180 and at least one stand body cavity width 182. In one example, the stand body cavity width 182 is greater than the stand body channel width 168 by an amount or difference 184. This difference 184 may allow for the main body 102 to rest within the stand body cavity 138 at a height lower than the stand body channel 136. This may prevent the shifting of the main body 102 relative to the at least one stand leg 104, reduce the possibility of the main body 102 and the stand leg 104 separating in inclement weather, and/or increase the general stability and robustness of the target stand 100 when in the assembled state.

In one aspect of the present disclosure, the first body section 140 may include a notch or recess 186 in a stand body exterior edge 188 opposite the at least one stand riser 132. The recess 186 may be approximately aligned with the stand body cavity 138, or alternatively be at least partially offset from the stand body cavity 138 without departing from the scope of the present disclosure. The recess 186 has a recess length 190 and a recess width 192. In one non-limiting example, the recess length 190 and the stand body cavity length 180 are approximately equal (e.g., where the recess 186 and the stand body cavity 138 are approximately aligned), with both the recess length 190 and the stand body cavity length 180 being equal to or greater than the main body width 146. The combination of the recess width 192 and the aligned, similarly dimensioned recess length 190 and stand body cavity length 180 may allow for the main body 102 to further rest within the stand body cavity 138 at a height lower than the stand body channel 136. This may further prevent the shifting of the main body 102 relative to the at least one stand leg 104, further reduce the possibility of the main body 102 and the stand leg 104 separating in inclement weather, and/or further increase the general stability and robustness of the target stand 100 when in the assembled state.

Referring now to 10B, an alternative exemplary stand leg 194 is shown. Unless otherwise noted, the stand leg 194 of FIG. 10B has features that are the same as, or similar to, the stand leg 104 of FIG. 10A and operates in the same or similar manner. In this regard, aspects or features to the stand leg 194 of FIG. 10B should be interpreted as being applicable to the stand leg 104 of FIG. 10A, and vice versa, unless otherwise noted. In addition, the stand leg 194 of FIG. 10B should be interpreted as being operable with the main body 102, similar to the stand leg 104 of FIG. 10A, unless otherwise noted.

The stand leg 194 includes at least one groove 196 in the stand body exterior edge 188 opposite the at least one stand riser 132. The at least one groove 196 includes a groove width 198 which is at least the thickness of the material from which the main body 102 is formed. Where there are multiple grooves 196, the multiple grooves 196 may be spaced apart an amount approximately equal to the main body width 146, less an amount approximately equal to once or twice the thickness of the material from which the main body 102 is formed, to ensure the main body 102 rests at least partially within the multiple groove widths 198. In this regard, when the stand leg 194 is inserted into the main body 102, the main body 102 will rest within the groove (or grooves) 196. This may reduce the possibility of the main body 102 and the stand leg 194 separating in inclement weather, and increase the general stability and robustness of the target stand 100 when in the assembled state.

In one non-limiting example, the stand body 134 may include a stand body channel 136 and a stand body cavity 138 with respective widths 168, 182 that are approximately equal. It is noted this feature may be applicable to the stand leg 194 including the groove 196 or the recess 186. In addition, it is noted this feature may be applicable to the stand leg 104 including the recess 186 or the groove 196.

Figure 10B:
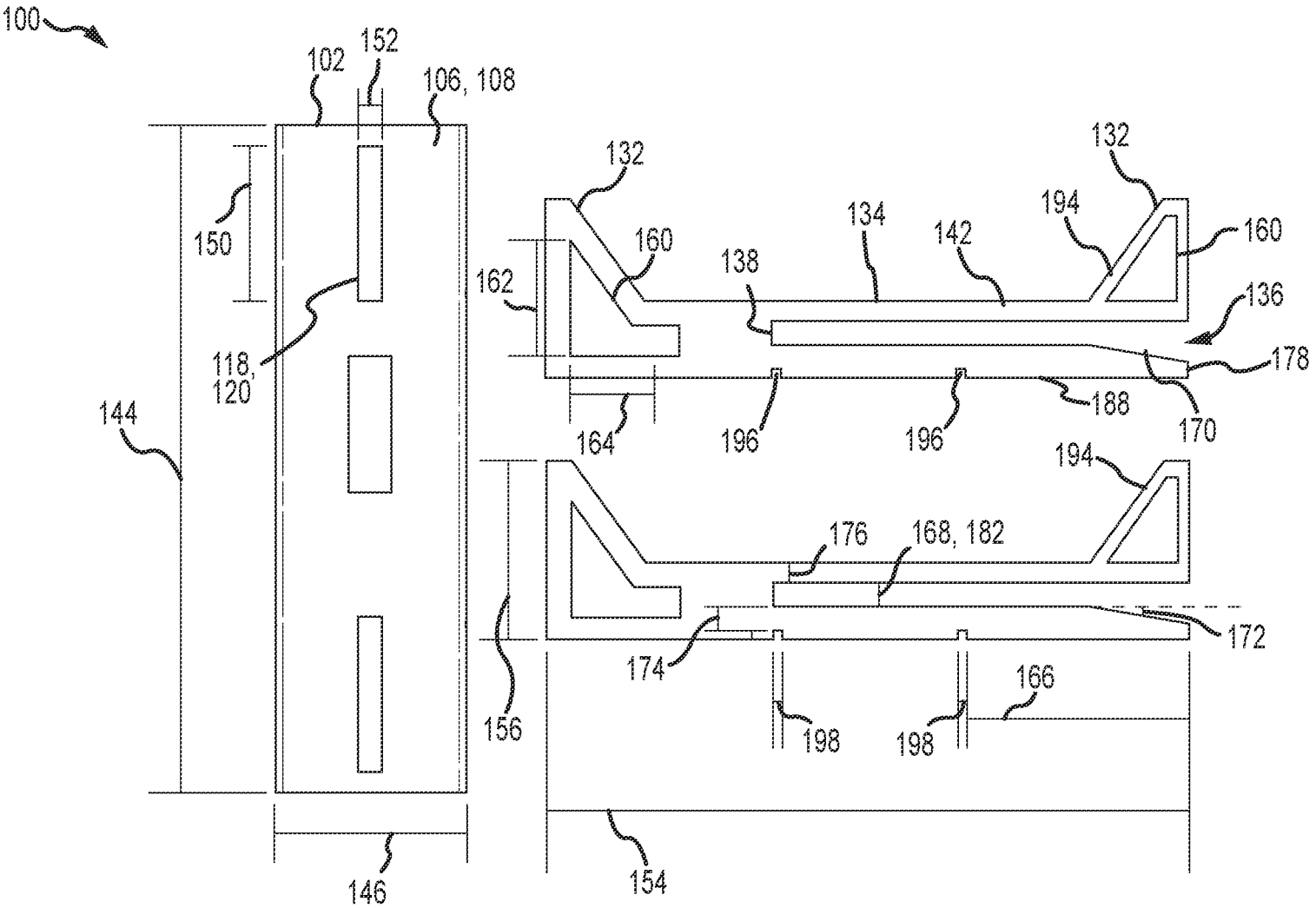
FIG. 10B shows an alternative target stand in a disassembled state with two legs uncoupled from a main body, in accordance with aspects of the present disclosure.
Figure 10C:
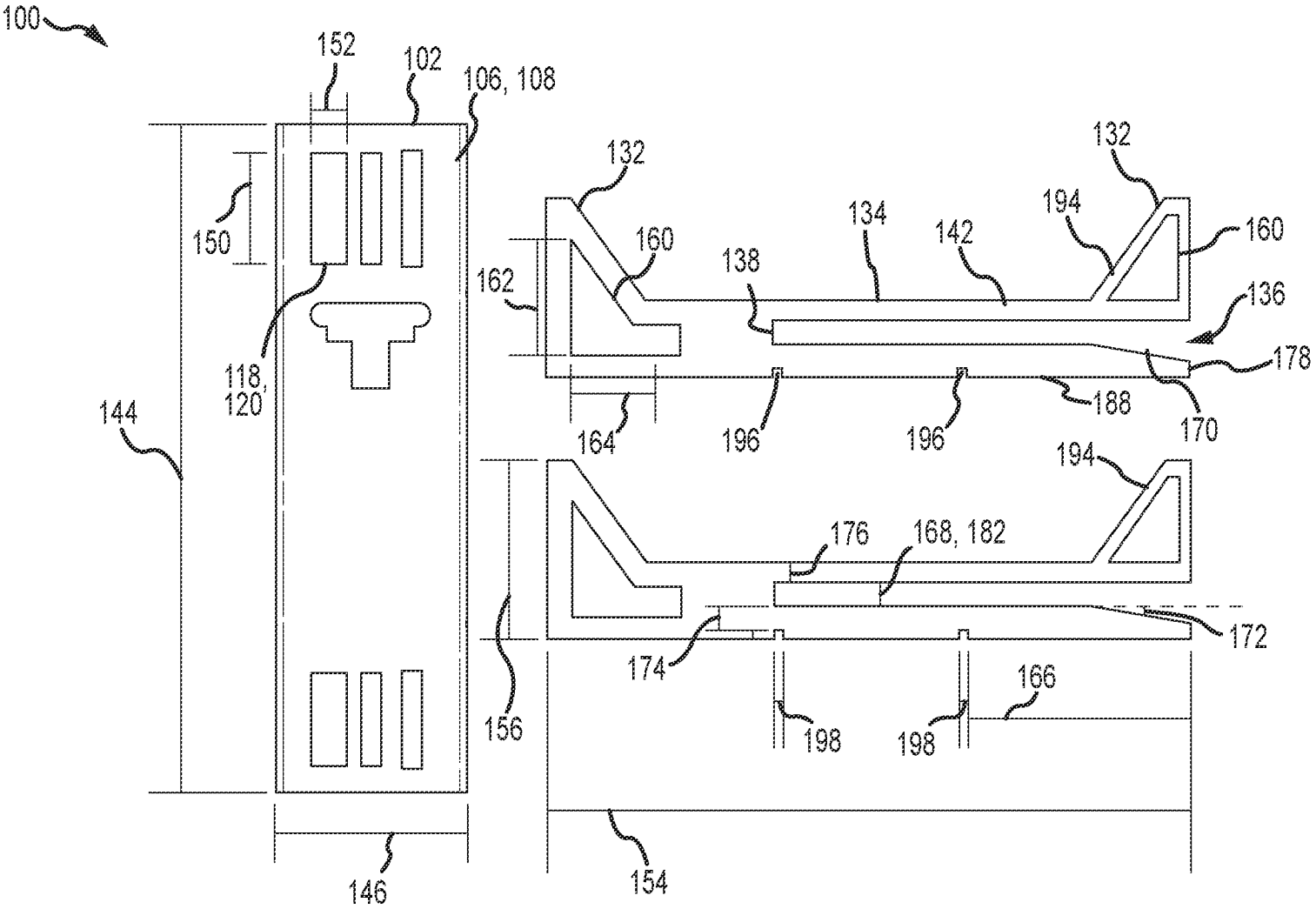
FIG. 10C shows an alternative target stand in a disassembled state with two legs uncoupled from a main body, in accordance with aspects of the present disclosure.

FIG. 10B also shows an alternative exemplary main body 102. Unless otherwise noted, the main body 102 of FIG. 10B has features that are the same as, or similar to, the main body 102 of FIG. 10A and operates in the same or similar manner. For example, the main body 102 of FIG. 10B should be considered equivalent to the main body 102 of FIG. 10A except for a difference in the number, positioning, size, and/or shape of the top support member apertures 118 in the top surface 106 and/or bottom support member apertures 120 in the bottom surface 108, respectively. In this regard, aspects or features to the main body 102 of FIG. 10B should be interpreted as being applicable to the main body 102 of FIG. 10A, and vice versa, unless otherwise noted. In addition, the main body 102 of FIG. 10B should be interpreted as being operable with the stand leg 104 or stand leg 194 as shown throughout the present disclosure, unless otherwise noted.

Referring now to 10C, another alternative exemplary main body 102 is shown. Unless otherwise noted, the main body 102 of FIG. 10C has features that are the same as, or similar to, the main body 102 of FIGS. 10A and/or 10B and operates in the same or similar manner. For example, the main body of FIG. 10C should be considered equivalent to the main body 102 of FIGS. 10A and/or 10B except for a difference in the number, positioning, size, and/or shape of the top support member apertures 118 in the top surface 106 and/or bottom support member apertures 120 in the bottom surface 108, respectively. In this regard, aspects or features to the main body 102 of FIGS. 10A and/or 10B should be interpreted as being applicable to the main body 102 of FIG. 10C, and vice versa, unless otherwise noted. In addition, the main body 102 of FIG. 10C should be interpreted as being operable with the stand leg 104 or stand leg 194 as shown throughout the present disclosure, unless otherwise noted.

FIGS. 11-16D generally illustrate a system 200 for target practice including the collapsible and self-contained target stand 100, in accordance with aspects of the present disclosure.

The system 200 includes a support member 202 coupled to or integrated with a shooting target 204. The support member 202 may be fabricated from a same, similar, or different material as one or more components of the target stand 100. For example, the support member 202 may be formed from a material including, but not limited to, a metal, a plastic, a wood, a fiberglass, a carbon fiber, or other material capable of being formed into a rigid or semi-rigid structure for the support member 202. For example, the support member 202 may be a sourced item fabricated from wood such as a section of pre-cut lumber (e.g., 1×2, 1×3, 1×4, 1×6, 1×8, 2×2, 2×3, 2×4, 2×6, 2×8, 4×4, or the like) to increase an ease of production or manufacturing and reduce costs of the components of the system 200.

In one non-limiting example, at least the top support member aperture 118 (e.g., 118*a*, 118*c*, and/or 118*e* as described throughout the disclosure) may be operable to receive a support member 202 fabricated from a 2×2, a 2×3, and/or a 2×4 piece of pre-cut lumber. In another non-limiting example, at least the top support member aperture 118 (e.g., 118*b*, 118*d*, and/or 118*f* as described throughout the disclosure) may be operable to receive a support member 202 fabricated from a 1×2, a 1×3, and/or a 1×4 piece of pre-cut lumber. In this regard, the target stand 100 is capable of being usable with numerous types or builds of shooting targets 204 with support members 202.

The shooting target 204 may be fabricated from a same, similar, or different material as one or more components of the target stand 100. For example, the shooting target 204 may be formed from a material including, but not limited to, plastic, paper, cardboard, wood, or steel. The shooting target 204 may be coupled to or integrated with one or multiple support members 202.

It is noted it may be preferable to have shooting targets 204 fabricated from different materials be in different orientations relative to the target stand 100. In one non-limiting example, a paper or cardboard printed target may be oriented in a direction toward a long edge of the target stand 100. In another non-limiting example, a metal target may be oriented in a direction toward a short edge of the target stand 100. In this regard, the target stand 100 may be usable for any number of types of shooting targets 204 oriented in multiple different directions.

One or more of the support member apertures 118, 120 may be dimensioned to receive the support member 202. For example, where the support member 202 is pre-cut lumber (e.g., a 2×4, or the like), the support member apertures 118, 120 may include at least one support member aperture length 150 and at least one support member aperture width 152 which is equal to or greater than the dimensions of the pre-cut lumber. For instance, the support member apertures 118, 120 (e.g., exemplary support member apertures 118*a*-118*e*, 120*a*-120*e*, or the like) may include a single support member aperture length 150 and a single support member aperture width 152 to orient the support member 202 (and shooting target 204) in a single direction. In addition, the support member apertures 118, 120 (e.g., exemplary support member apertures 118*f*-118*g*, 120*f*-120*g*, or the like) may include a first support member aperture length 150 (or first section of a length 150) and a first support member aperture width 152 (or first section of a width 152) to orient the support member 202 (and shooting target 204) in a first direction, and may include a second support member aperture length 150 (or second section of the length 150) and a second support member aperture width 152 (or second section of the width 152) to orient the support member 202 (and shooting target 204) in a second direction different from the first direction. It is noted the dimensions of the support member apertures 118, 120 may allow for increased ease of interaction by a user to insert their hand and lift or move the target stand 100 during relocation (e.g., in an assembled state or disassembled state), during transportation (e.g., in an assembled state, or in a collapsed state) and/or when placing in or removing from storage (e.g., in a collapsed state).

It is noted the reference to dimensions 150, 152 have been removed from the example configurations of the system 200 in FIGS. 11-16D solely for purposes of clarity, and may be referred to in at least FIGS. 10A and 10B.

Figure 11:
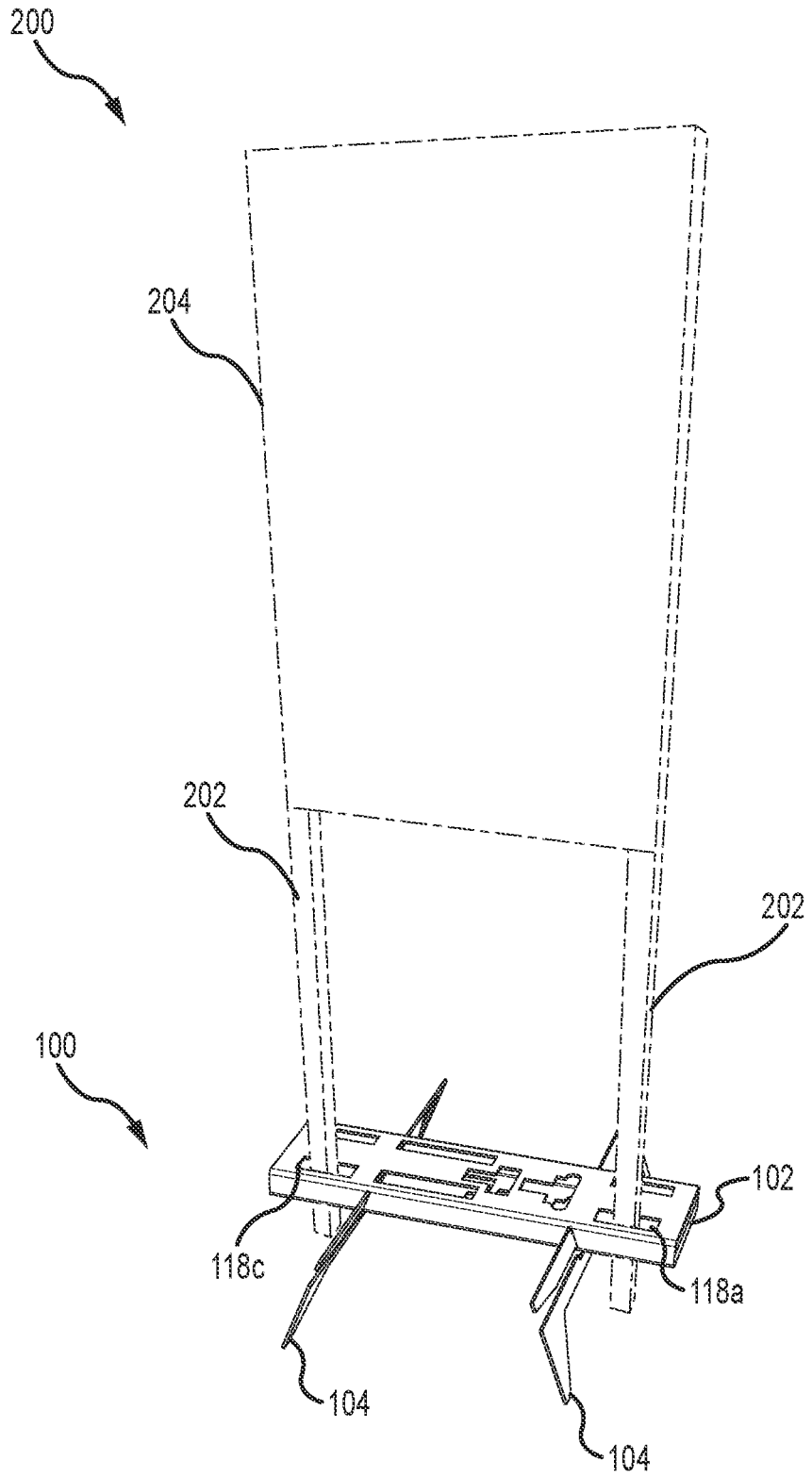
FIG. 11 shows a system including the target stand of FIG. 1 in the assembled state and a shooting target, in accordance with aspects of the present disclosure.

Referring now to the example configuration of the system 200 shown in FIG. 11, a first support member 202 is inserted in the support member aperture 118*a* and a second support member 202 is inserted in the support member aperture 118*c*, with a shooting target 204 spanning between the first and second support members 202. The length 150 of the support member apertures 118*a*, 118*c* are longer than the length of the support members 202, but the width 152 is approximately equal to the width of the support members 202. In this example configuration, the shown set of support members (or another set of support members having a greater length) may be used with the support member apertures 118*a*, 118*c*. The shooting target 204 is oriented facing the long edge or length of the main body 102.

Figure 12:
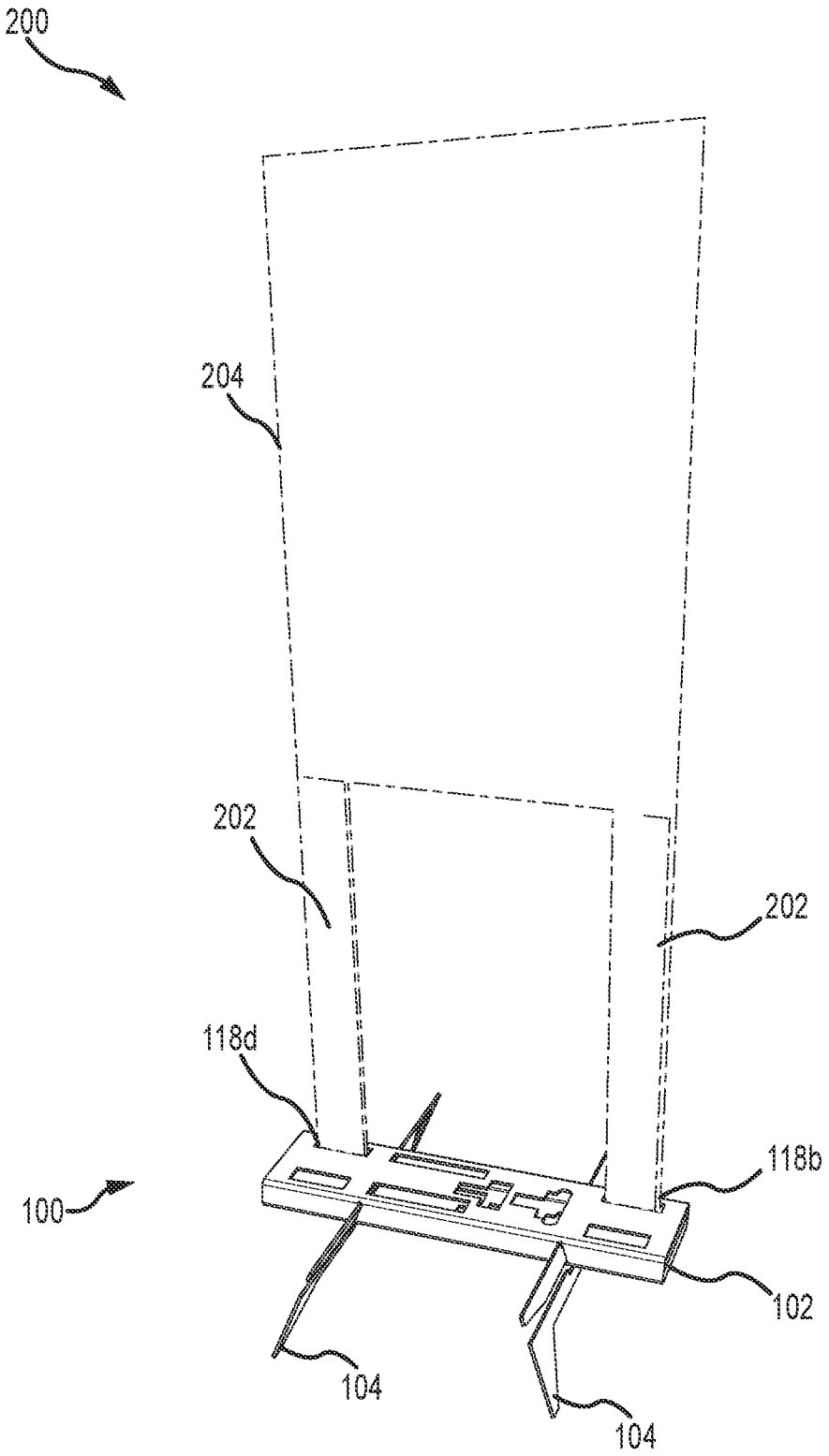
FIG. 12 shows the system of FIG. 11 with the target stand of FIG. 1 and the shooting target.

Referring now to the example configuration of the system 200 shown in FIG. 12, a first support member 202 is inserted in the support member aperture 118*b* and a second support member 202 is inserted in the support member aperture 118*d*, with a shooting target 204 spanning between the first and second support members 202. The length 150 and width 152 of the support member apertures 118*b*, 118*d* are approximately equal to the length and width of the support members 202. In this example configuration, the shown set of support members (or another set of support members having a lesser length and/or width) may be used with the support member apertures 118*b*, 118*d*. The shooting target 204 is oriented facing the long edge or length of the main body 102.

Figure 13:
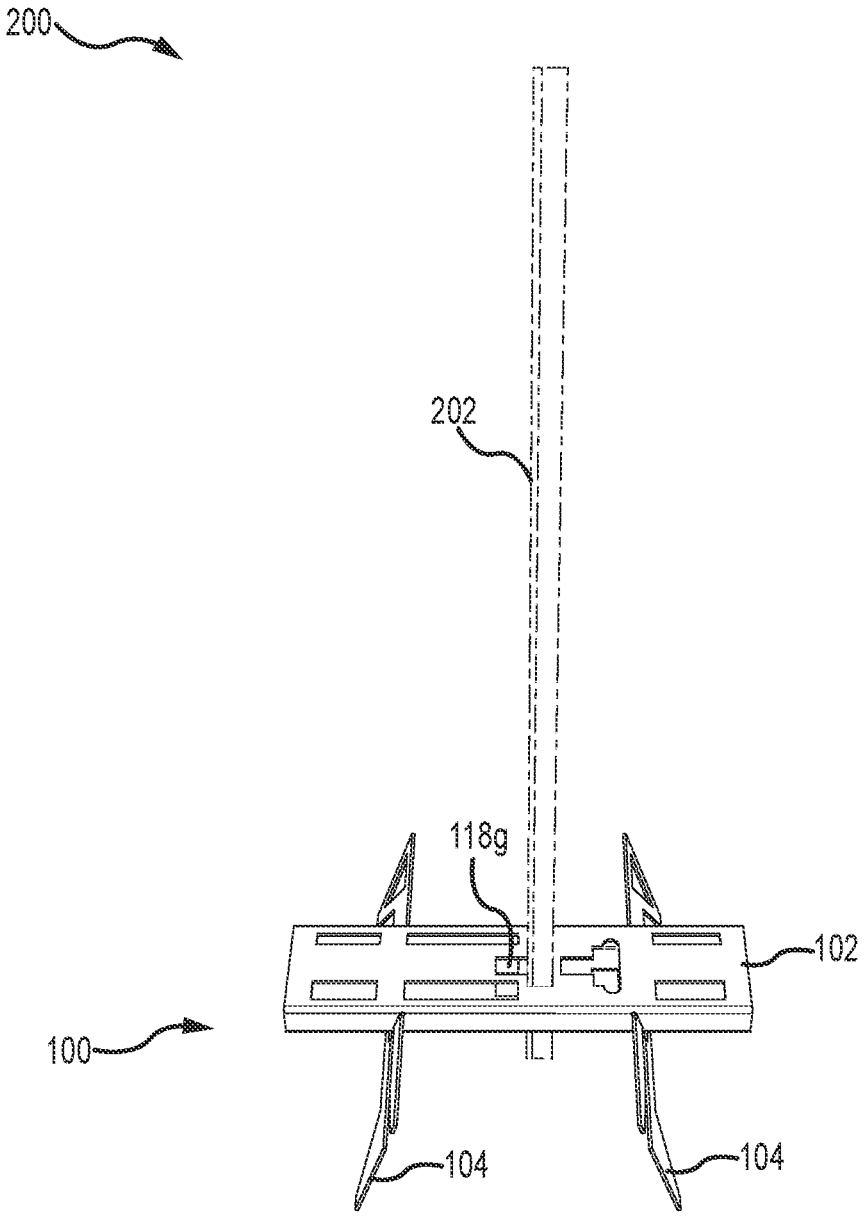
FIG. 13 shows the system of FIG. 11 with the target stand of FIG. 1 and the shooting target.
Figure 14:
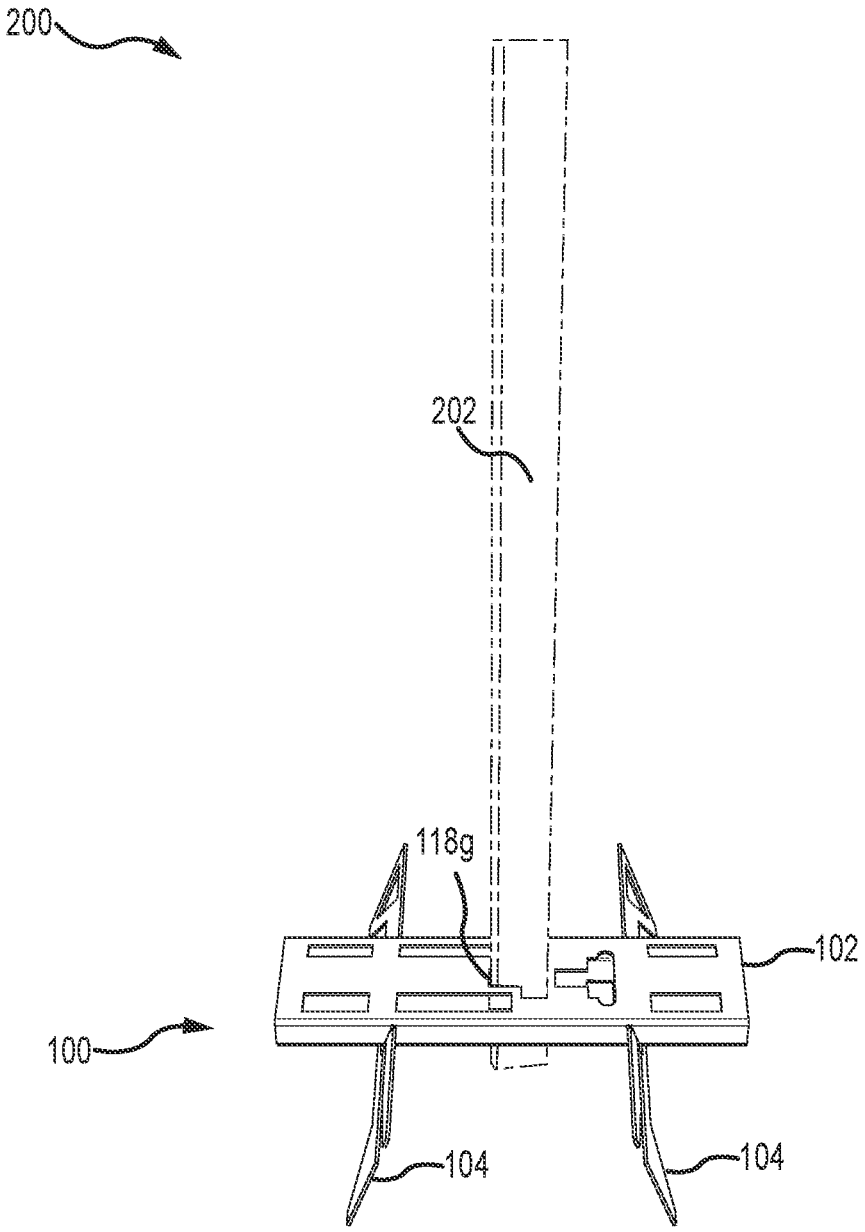
FIG. 14 shows the system of FIG. 11 with the target stand of FIG. 1 and the shooting target.

Referring now to the example configuration of the system 200 shown in FIGS. 13 and 14, a support member 202 is inserted in the support member aperture 118*g*. The support member aperture 118*g* is a complex shape with a first length 150 and first width 152, and a second length 150 and second width 152 (or first and second portions of a length 150 and width 152). As illustrated in FIG. 13, the first length 150 and first width 152 are approximately equal to the width and length of the support member 202, such that the support member 202 is oriented in a first direction facing the short edge or width of the main body 102. As illustrated in FIG. 14, the second length 150 and second width 152 are approximately equal to the length and width of the support member 202, such that the support member 202 is oriented in a second direction facing the long edge or length of the main body 102, different from the first direction.

Figure 15:
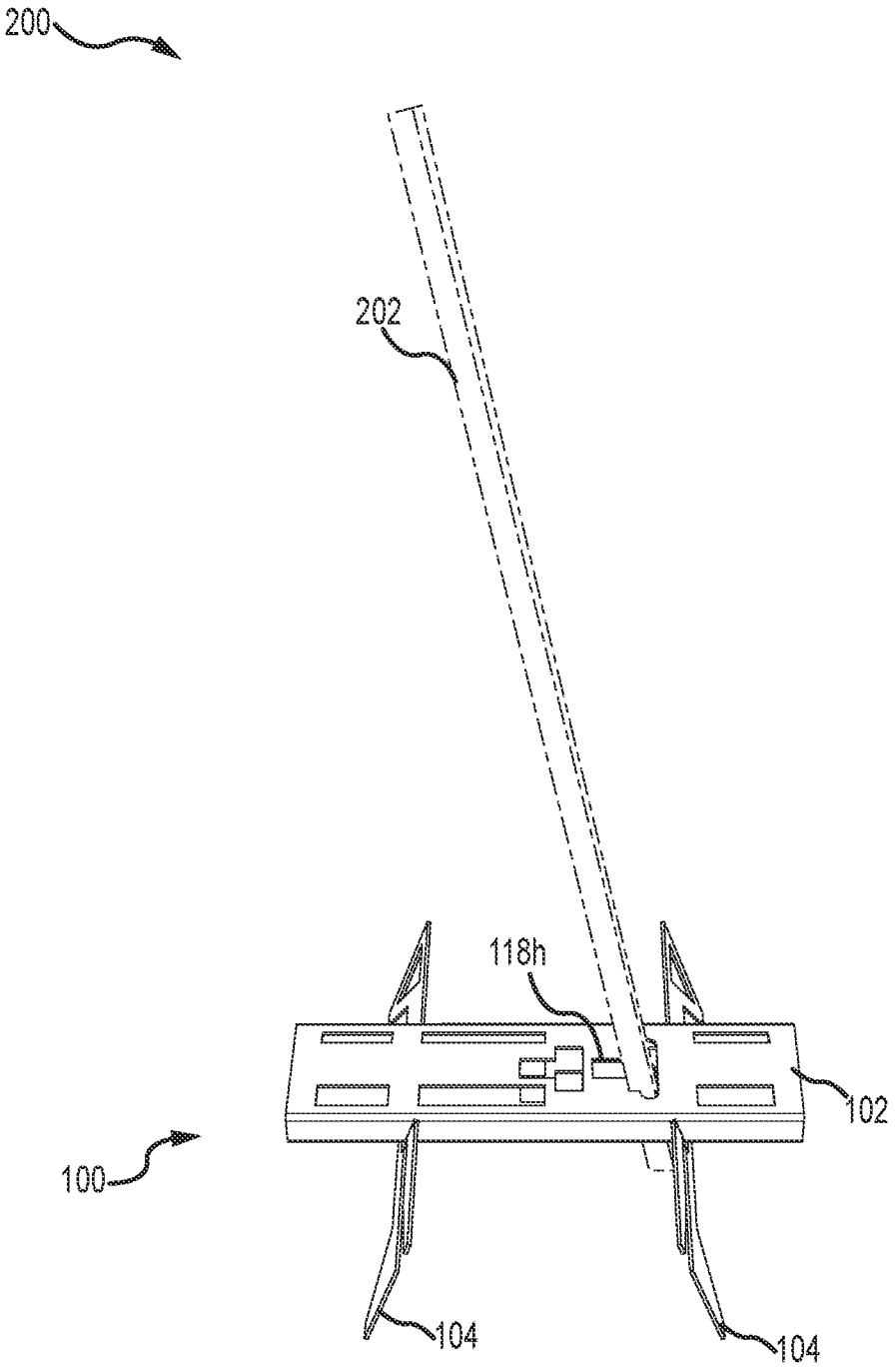
FIG. 15 shows the system of FIG. 11 with the target stand of FIG. 1 and the shooting target.

Referring now to the example configuration of the system 200 shown in FIG. 15, a support member 202 is inserted in the support member apertures 118*h*, 120*h*. The support member 118*h* includes at least a first length 150 and at least a first width 152 (or at least a first portion of a complete length 150 and complete width 152). The at least a first length 150 is greater than the width of the support member 202, allowing for an angle, while the at least a first width 152 and the length of the support member 202 are approximately equal. The support member 202 is oriented in a first direction facing the short edge or width of the main body 102, and angled toward the short edge or width of the main body 102.

Referring now to the example configuration of the system 200 shown in FIG. 16A-16D, a support member 202 is inserted in the support member apertures 118*h*, 120*h* at a second orientation or direction different from the first orientation or direction shown in FIG. 15. The support member 118*h* includes at least a second length 150 and at least a second width 152 (or at least a second portion of a length 150 and width 152). The support member 202 (and the shooting target 204) are oriented in a second direction facing the long edge or length of the main body 102, different from the first direction, but angled toward the short edge or width of the main body 102. The at least a second length 150 is equal to or greater than the length of the support member 202, allowing for an angle where the shooting target 204 leans toward a short edge, while the at least a second width 152 and the width of the support member 202 are approximately equal which prevents the shooting target 204 from leaning at a second angle (e.g., toward one long edge or the other).

It is noted the angles shown in FIGS. 15-16D may be accomplished due to the spacing between the bottom surface 108 of the main body 102 and the ground surface 105 afforded by the increased height of the stand risers 132, and/or by the support member apertures 118*h*, 120*h* being offset (e.g., not fully aligned) from one another. The angles may be particularly important to direct fragmentation from a projectile striking the shooting target 204 toward the ground beneath the target, thus reducing the possibility of potential send-back ricocheting in the direction of the user or another third-party in the surrounding area. In addition, it is noted the of the support member 202 within the target stand 100 may be in addition to or instead of an angle between the support member 202 and the shooting target 204.

It is noted at least a portion of the support member apertures 118*h*, 120*h* may be arcuate, allowing for an increase comfort and ease when a user interacts with the support member apertures 118*h*, 120*h* to insert their hand and lift or move the target stand 100 during relocation (e.g., in an assembled state or disassembled state), during transportation (e.g., in an assembled state, or in a collapsed state) and/or when placing in or removing from storage (e.g., in a collapsed state).

Any of the steps, functions, and operations discussed herein can be performed continuously and automatically.

While the steps have been discussed and illustrated in relation to a particular sequence of events, it should be appreciated that changes, additions, and omissions to this sequence can occur without materially affecting the operation of the disclosed embodiments, configuration, and aspects.

The exemplary systems and methods of this disclosure have been described in relation to the target stand 100. However, to avoid unnecessarily obscuring the present disclosure, the preceding description may omit a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

It should be understood that portions of the target stand 100 may not form part of the claimed invention or design but rather is only a portion of an environment in which the claimed invention or design operates. In one non-limiting example, one or more aspects of the main body 102 and/or the at least one stand leg 104 may not form part of the claimed invention or design but rather is only a portion of an environment in which the claimed invention or design operates. In one instance, one or more of the apertures 118, 120, 122, 124, 126 may not form part of the claimed invention or design but rather is only a portion of an environment in which the claimed invention or design operates. Therefore, the description through the present disclosure should not be interpreted as a limitation on the scope of the present disclosure but merely an illustration.

A number of variations and modifications of the disclosure can be used. It would be possible to provide for some features of the disclosure without providing others. In addition, it would be possible to combine some features of the disclosure without combining all.

References in the specification to "being operable" or "is operable" may be understood as "being configured to" or "is configured to, "being capable of" or "is capable of", and the like.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in conjunction with one embodiment, it is submitted that the description of such feature, structure, or characteristic may apply to any other embodiment unless so stated and/or except as will be readily apparent to one skilled in the art from the description. The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the systems and methods disclosed herein after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Exemplary aspects are directed toward:

A self-contained and collapsible target stand, comprising:

a main body comprising:

a top surface including at least one top support member aperture, wherein the at least one top support member aperture is dimensioned to receive a support member for a shooting target;

a first side surface including at least one first side stand leg aperture; and a second side surface opposite the first side surface, the second side surface including at least one second side stand leg aperture opposite the at least one first side stand leg aperture, wherein the top surface is set at an angle relative to each of the first side surface and the second side surface, and wherein the top surface, the first side surface, and the second side surface define a main body cavity; and at least one stand leg comprising:

a stand body, wherein the stand body defines a stand body channel leading to a stand body cavity; and at least one stand riser affixed to the stand body, wherein the target stand is capable of transitioning between an assembled state and a collapsed state, wherein the at least one stand leg is inserted into the at least one first side stand leg aperture and the at least one second side stand leg aperture when the target stand is in the assembled state, and wherein the at least one stand leg is inserted into the main body cavity when the target stand is in the collapsed state.

Any one or more of the above aspects include wherein the stand body includes a first stand body section and a second stand body section separated by the stand body channel leading to the stand body cavity, wherein the first stand body section is inserted into the at least one first side stand leg aperture and the at least one second side stand leg aperture when the target stand is in the assembled state, and wherein the bottom surface is proximate to the second stand body section when the target stand is in the assembled state.

Any one or more of the above aspects include wherein the main body is configured to seat within a recess in an exterior edge of the first stand body section, wherein the seating of the main body within the recess prevents a shifting of the main body relative to the at least one stand leg when the target stand is in the assembled state.

Any one or more of the above aspects include wherein the first stand body section has a first width proximate to the stand body cavity and a second width at a distal end of the first stand body section, wherein the second width is less than the first width.

Any one or more of the above aspects include wherein the main body is configured to seat in the stand body cavity at a first height in the at least one stand leg relative to a ground surface that is less than a second height of the stand body channel in the at least one stand leg relative to the ground surface, wherein the lesser first height prevents the shifting of the main body relative to the at least one stand leg when the target stand is in the assembled state.

Any one or more of the above aspects include the main body further comprising a bottom surface opposite the top surface, wherein the top surface and the bottom surface are both set at an angle relative to each of the first side surface and the second side surface, wherein the top surface, the bottom surface, the first side surface, and the second side surface define the main body cavity.

Any one or more of the above aspects include wherein the bottom surface includes at least one bottom support member aperture opposite the at least one top support member aperture, wherein the at least one bottom support member aperture is dimensioned to receive the support member.

Any one or more of the above aspects include the main body further comprising a first end surface, wherein the first end surface is set at an angle relative to each of the top surface, the bottom surface, the first side surface, and the second side surface, wherein the top surface, the bottom surface, the first side surface, the second side surface, and the first end surface define the main body cavity.

Any one or more of the above aspects include the first end surface having a first end aperture and an end surface portion, wherein the at least one stand leg is inserted into the main body cavity via the first end aperture when the target stand is in the collapsed state.

Any one or more of the above aspects include the main body further comprising a second end surface opposite the first end surface, wherein the second end surface is set at an angle relative to each of the top surface, the bottom surface, the first side surface, the second side surface, and the first end surface, wherein the top surface, the bottom surface, the first side surface, the second side surface, the first end surface, and the second end surface the define the main body cavity.

Any one or more of the above aspects include wherein the at least one top support member aperture includes a perimeter, wherein at least a portion of the perimeter is arcuate.

Any one or more of the above aspects include wherein the at least one top support member aperture includes a first length and a first width configured to receive the support member.

Any one or more of the above aspects include wherein the at least one top support member aperture includes a first portion with a first length and a first width configured to receive the support member in a first orientation, and a second portion with a second length and a second width configured to receive the support member in a second orientation different from the first orientation.

Any one or more of the above aspects include wherein the at least one top support member aperture is configured to receive the support member at an angle relative to a ground surface.

Exemplary aspects are directed toward:

A system for target practice, comprising:

a self-contained and collapsible target stand, comprising:

a main body comprising:

a top surface including at least one top support member aperture, wherein the at least one top support member aperture is dimensioned to receive a support member for a shooting target;

a first side surface including at least one first side stand leg aperture; and a second side surface opposite the first side surface, the second side surface including at least one second side stand leg aperture opposite the at least one first side stand leg aperture, wherein the top surface is set at an angle relative to each of the first side surface and the second side surface, and wherein the top surface, the first side surface, and the second side surface define a main body cavity; and at least one stand leg comprising:

a stand body, wherein the stand body defines a stand body channel leading to a stand body cavity; and at least one stand riser affixed to the stand body, wherein the target stand is capable of transitioning between an assembled state and a collapsed state, wherein the at least one stand leg is inserted into the at least one first side stand leg aperture and the at least one second side stand leg aperture when the target stand is in the assembled state, and wherein the at least one stand leg is inserted into the main body cavity when the target stand is in the collapsed state;

at least one support member insertable into the at least one top support member aperture; and a shooting target couplable to the support member. Any one or more of the above aspects include wherein the at least one top support member aperture includes a first length and a first width configured to receive the support member.

Any one or more of the above aspects include wherein the at least one top support member aperture includes a first portion with a first length and a first width configured to receive the support member in a first orientation, and a second portion with a second length and a second width configured to receive the support member in a second orientation different from the first orientation.

Any one or more of the above aspects include wherein the at least one top support member aperture is configured to receive the support member at an angle relative to a ground surface.

Exemplary aspects are directed toward:

A self-contained and collapsible target stand, comprising:

a main body comprising:

a top surface including at least one top support member aperture, wherein the at least one top support member aperture is dimensioned to receive a support member for a shooting target;

a bottom end surface opposite the top surface;

a first side surface including two first side stand leg apertures;

a second side surface opposite the first side surface, the second side surface including two second side stand leg apertures opposite the two first side stand leg apertures;

a first end surface including a first end aperture and an end surface portion; and a second end surface opposite the first end surface, wherein the top surface and the bottom surface are both set at an angle relative to each of the first side surface, the second side surface, the first end surface, and the second end surface, and wherein the top surface, the bottom surface, the first side surface, the second side surface, the first end surface, and the second end surface define a main body cavity; and two stand legs, each of the two stand legs comprising:

a stand body, wherein the stand body defines a stand body channel leading to a stand body cavity; and at least one stand riser affixed to the stand body, wherein the target stand is capable of transitioning between an assembled state and a collapsed state, wherein the two stand legs are inserted into the two first side stand leg apertures and the two second side stand leg apertures when the target stand is in the assembled state, and wherein the two stand legs are inserted into the main body cavity via the first end aperture when the target stand is in the collapsed state.

Any one or more of the above aspects include wherein the bottom surface includes at least one bottom support member aperture opposite the at least one top support member aperture, wherein the at least one bottom support member aperture is dimensioned to receive the support member.

Any one or more of the above aspects/embodiments as substantially disclosed herein.

Any one or more of the aspects/embodiments as substantially disclosed herein optionally in combination with any one or more other aspects/embodiments as substantially disclosed herein.

One or means adapted to perform any one or more of the above aspects/embodiments as substantially disclosed herein.

Any one or more of the features disclosed herein.

Any one or more of the features as substantially disclosed herein.

Any one or more of the features as substantially disclosed herein in combination with any one or more other features as substantially disclosed herein.

Any one of the aspects/features/embodiments in combination with any one or more other aspects/features/embodiments.

Use of any one or more of the aspects or features as disclosed herein.

It is to be appreciated that any feature described herein can be claimed in combination with any other feature(s) as described herein, regardless of whether the features come from the same described embodiment.

As used herein, the singular forms "a," "an," and "the" are intended to include the plural forms as well, unless the context clearly indicates otherwise. It will be further understood that the terms "include," "including," "includes," "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items. The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

The transitional phrase "consisting of" excludes any element, step, or ingredient not specified in the claim, but does not exclude additional components or steps that are unrelated to the disclosure such as impurities ordinarily associated therewith. The transitional phrase "consisting essentially of" limits the scope of a claim to the specified materials or steps and those that do not materially affect the basic and novel characteristic(s) of the claimed invention.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together. When each one of A, B, and C in the above expressions refers to an element, such as X, Y, and Z, or a class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The terms "determine," "calculate," "compute," and variations thereof, as used herein, are used interchangeably and include any type of methodology, process, mathematical operation, or technique.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and this disclosure.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims may be increased or decreased by approximately 5% to achieve satisfactory results. Additionally, where the meaning of the terms "about" or "approximately" as used herein would not otherwise be apparent to one of ordinary skill in the art, the terms "about" and "approximately" should be interpreted as meaning within plus or minus 5% of the stated value.

All ranges described herein may be reduced to any sub-range or portion of the range, or to any value within the range without deviating from the invention. For example, the range "5 to 55" includes, but is not limited to, the sub-ranges "5 to 20" as well as "17 to 54."

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

What is claimed is:

1. A self-contained and collapsible target stand, comprising:

a main body comprising:

a top surface including at least one top support member aperture, wherein the at least one top support member aperture is dimensioned to receive a support member for a shooting target;

a first side surface including at least one first side stand leg aperture; and a second side surface opposite the first side surface, the second side surface including at least one second side stand leg aperture opposite the at least one first side stand leg aperture, wherein the top surface is set at an angle relative to each of the first side surface and the second side surface, and wherein the top surface, the first side surface, and the second side surface define a main body cavity; and at least one stand leg comprising:

a stand body including a first stand body section and a second stand body section, wherein the first stand body section and the second stand body section are separated by a stand body channel extending along a length of the stand body and leading to a stand body cavity; and at least one stand riser affixed to the stand body, wherein the target stand is capable of transitioning between an assembled state and a collapsed state, wherein the first stand body section of the at least one stand leg is inserted into the at least one first side stand leg aperture and exits the at least one second side stand leg aperture when the target stand is in the assembled state, and wherein the at least one stand leg is inserted into the main body cavity when the target stand is in the collapsed state.

2. The target stand of claim 1, wherein the stand body channel receives a portion of the main body following insertion of the first stand body section such that a bottom surface of the main body is proximate to the second stand body section when the target stand is in the assembled state.

3. The target stand of claim 2, wherein the main body is configured to seat within a recess in an exterior edge of the first stand body section, wherein the seating of the main body within the recess prevents a shifting of the main body relative to the at least one stand leg when the target stand is in the assembled state.

4. The target stand of claim 2, wherein the first stand body section has a first width proximate to the stand body cavity and a second width at a distal end of the first stand body section, wherein the second width is less than the first width.

5. The target stand of claim 1, wherein the main body is configured to seat in the stand body cavity at a first height in the at least one stand leg relative to a ground surface that is less than a second height of the stand body channel in the at least one stand leg relative to the ground surface, wherein the lesser first height prevents the main body from shifting relative to the at least one stand leg when the target stand is in the assembled state.

6. The target stand of claim 1, the main body further comprising a bottom surface opposite the top surface, wherein the top surface and the bottom surface are both set at an angle relative to each of the first side surface and the second side surface, wherein the top surface, the bottom surface, the first side surface, and the second side surface define the main body cavity.

7. The target stand of claim 6, wherein the bottom surface includes at least one bottom support member aperture opposite the at least one top support member aperture, wherein the at least one bottom support member aperture is dimensioned to receive the support member.

8. The target stand of claim 6, the main body further comprising a first end surface, wherein the first end surface is set at an angle relative to each of the top surface, the bottom surface, the first side surface, and the second side surface, wherein the top surface, the bottom surface, the first side surface, the second side surface, and the first end surface define the main body cavity.

9. The target stand of claim 8, the first end surface including a first end aperture and an end surface portion, wherein the at least one stand leg is inserted into the main body cavity via the first end aperture when the target stand is in the collapsed state.

10. The target stand of claim 9, the main body further comprising a second end surface opposite the first end surface, wherein the second end surface is set at an angle relative to each of the top surface, the bottom surface, the first side surface, and the second side surface, and the first-end-surface;

wherein the top surface, the bottom surface, the first side surface, the second side surface, the first end surface, and the second end surface define the main body cavity.

11. The target stand of claim 1, wherein the at least one top support member aperture includes a perimeter, wherein at least a portion of the perimeter is arcuate.

12. The target stand of claim 1, wherein the at least one top support member aperture includes a first length and a first width configured to receive the support member.

13. The target stand of claim 1, wherein the at least one top support member aperture includes a first portion with a first length and a first width configured to receive the support member in a first orientation, and a second portion with a second length and a second width configured to receive the support member in a second orientation different from the first orientation.

14. The target stand of claim 1, wherein the at least one top support member aperture is configured to receive the support member at an angle relative to a ground surface.

15. A system for target practice, comprising:

a self-contained and collapsible target stand, comprising:

a main body comprising:

a top surface including at least one top support member aperture, wherein the at least one top support member aperture is dimensioned to receive a support member for a shooting target;

a first side surface including at least one first side stand leg aperture; and a second side surface opposite the first side surface, the second side surface including at least one second side stand leg aperture opposite the at least one first side stand leg aperture, wherein the top surface is set at an angle relative to each of the first side surface and the second side surface, and wherein the top surface, the first side surface, and the second side surface define a main body cavity; and at least one stand leg comprising:

a stand body, wherein the stand body includes a first stand body section and a second stand body section separated by a stand body channel extending along a length of the stand body and leading to a stand body cavity; and at least one stand riser affixed to the stand body, wherein the target stand is capable of transitioning between an assembled state and a collapsed state, wherein the first stand body section of the at least one stand leg is inserted into the at least one first side stand leg aperture, extends within the main body cavity between the first side surface and the second side surface, and exits the at least one second side stand leg aperture when the target stand is in the assembled state, and wherein the at least one stand leg is inserted into the main body cavity when the target stand is in the collapsed state;

at least one support member insertable into the at least one top support member aperture; and a shooting target couplable to the support member.

16. The system of claim 15, wherein the at least one top support member aperture includes a first length and a first width configured to receive the support member.

17. The system of claim 15, wherein the at least one top support member aperture includes a first portion with a first length and a first width configured to receive the support member in a first orientation, and a second portion with a second length and a second width configured to receive the support member in a second orientation different from the first orientation.

18. The system of claim 15, wherein the at least one top support member aperture is configured to receive the support member at an angle relative to a ground surface.

19. A self-contained and collapsible target stand, comprising:

a main body comprising:

a top surface including at least one top support member aperture, wherein the at least one top support member aperture is dimensioned to receive a support member for a shooting target;

a bottom surface opposite the top surface;

a first side surface including two first side stand leg apertures;

a second side surface opposite the first side surface, the second side surface including two second side stand leg apertures opposite the two first side stand leg apertures;

a first end surface including a first end aperture that is accessible within a non-movable end surface portion; and a second end surface opposite the first end surface, wherein the top surface and the bottom surface are both set at an angle relative to each of the first side surface, the second side surface, the first end surface, and the second end surface, and wherein the top surface, the bottom surface, the first side surface, the second side surface, the first end surface, and the second end surface define a main body cavity; and two stand legs, each of the two stand legs comprising:

a stand body, wherein the stand body includes a first stand body section and a second stand body section separated by a stand body channel extending along a length of the stand body and leading to a stand body cavity; and at least one stand riser affixed to the stand body, wherein the target stand is capable of transitioning between an assembled state and a collapsed state, wherein the first stand body sections of the two stand legs are inserted into the two first side stand leg apertures, pass through the main body cavity, and exit the two second side stand leg apertures when the target stand is in the assembled state, and wherein the two stand legs are inserted into the main body cavity via the first end aperture when the target stand is in the collapsed state.

20. The target stand of claim 19, wherein the bottom surface includes at least one bottom support member aperture opposite the at least one top support member aperture, wherein the at least one bottom support member aperture is dimensioned to receive the support member.

* * * * *